US010645978B2

(12) United States Patent
Kehler et al.

(10) Patent No.: US 10,645,978 B2
(45) Date of Patent: May 12, 2020

(54) RUNNING TIGHT WITH PRECONFIGURED COMPRESSION ZONES AND INTEGRATED STRUCTURE PATTERNS

(71) Applicant: NIKE, Inc., Beaverton, OR (US)

(72) Inventors: Alyse Kehler, Portland, OR (US); Richa Maheshwari, Hillsboro, OR (US); Christopher J. Ranalli, Portland, OR (US); Andrea J. Staub, Portland, OR (US); Heidi A. Vaughan, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 272 days.

(21) Appl. No.: 15/151,928

(22) Filed: May 11, 2016

(65) Prior Publication Data

US 2016/0338424 A1 Nov. 24, 2016

Related U.S. Application Data

(60) Provisional application No. 62/165,480, filed on May 22, 2015.

(51) Int. Cl.
*A41B 11/08* (2006.01)
*A41D 13/00* (2006.01)
(Continued)

(52) U.S. Cl.
CPC ..... *A41B 11/08* (2013.01); *A41D 1/08* (2013.01); *A41D 13/0015* (2013.01);
(Continued)

(58) Field of Classification Search
CPC .. A41D 1/08; A41D 13/0015; A41D 2500/10; D04B 21/207; D04B 21/18;
(Continued)

(56) References Cited

U.S. PATENT DOCUMENTS 1,367,065 A 2/1921 McCrahon
1,817,053 A 8/1931 Zerk
(Continued)

FOREIGN PATENT DOCUMENTS

CN 1981653 A 6/2007
CN 201563647 U 9/2010
(Continued)

OTHER PUBLICATIONS

International Preliminary Report on Patentability dated Dec. 7, 2017 in International Patent Application No. PCT/US2016/031492, 8 pages.

(Continued)

*Primary Examiner* — Khoa D Huynh
*Assistant Examiner* — Aiying Zhao
(74) *Attorney, Agent, or Firm* — Shook, Hardy and Bacon LLP

(57) ABSTRACT

A running tight having preconfigured compression zones with integrated structure patterns is provided herein. The compression zones may have differing compression forces where zones having a higher compression force are located at the thigh area and calf area of the tight, and zones having a lower compression force are located at the waist area and knee area of the tight. The integrated structure patterns modify the compression forces of the zones in the areas where the patterns are located in order to further customize the compressive properties of the running tight.

10 Claims, 17 Drawing Sheets

(51) Int. Cl.
*D04B 21/18* (2006.01)
*D04B 21/20* (2006.01)
*A41D 1/08* (2018.01)

(52) U.S. Cl.
CPC ..... *D04B 21/18* (2013.01); *D04B 21/207* (2013.01); *A41D 2500/10* (2013.01); *D10B 2501/02* (2013.01); *D10B 2501/021* (2013.01)

(58) Field of Classification Search
CPC ..... D04B 1/102; A41B 11/08; D10B 2501/02; D10B 2501/021
USPC ..... 2/242
See application file for complete search history.

(56) References Cited

U.S. PATENT DOCUMENTS 3,063,271 A * 11/1962 Faust ..... D04B 1/10 66/169 R
3,429,147 A 2/1969 Perrier
3,703,820 A 11/1972 Jackson
3,748,870 A 7/1973 Fregeolle
4,027,667 A 6/1977 Swallow et al.
4,086,790 A 5/1978 Hanrahan, Jr. et al.
4,089,064 A 5/1978 Chandler, Jr. et al.
4,156,294 A 5/1979 Horn
4,172,456 A 10/1979 Zens
4,176,665 A 12/1979 Terpening
4,180,065 A 12/1979 Bowen
4,213,312 A 7/1980 Cassidy, Sr. et al.
4,240,160 A 12/1980 Imboden et al.
4,422,307 A 12/1983 Thorneburg
4,502,301 A 3/1985 Swallow et al.
4,513,740 A 4/1985 Westlake
4,527,403 A 7/1985 Fullbright et al.
5,125,116 A 6/1992 Gaither et al.
5,367,708 A 11/1994 Fujimoto
5,581,817 A 12/1996 Hicks
5,720,042 A * 2/1998 Wilkinson ..... A41D 13/0015 2/69
5,823,013 A 10/1998 Lonati et al.
6,012,177 A 1/2000 Cortinovis
6,053,852 A 4/2000 Wilkinson
6,119,491 A 9/2000 Pinelli
6,216,495 B1 4/2001 Couzan et al.
6,341,506 B1 1/2002 Myers
7,159,621 B2 1/2007 Shannon
7,434,423 B1 10/2008 Reid, Jr. et al.
7,481,079 B1 * 1/2009 Waldrop ..... D04B 1/02 66/170
7,856,668 B2 12/2010 Demarest et al.
8,172,782 B2 * 5/2012 Rock ..... A61F 13/06 2/69
8,296,864 B2 10/2012 Torry
8,425,324 B2 4/2013 Kemmerling et al.
8,578,512 B2 11/2013 Moore et al.
9,777,413 B2 10/2017 Messier
2001/0013138 A1 8/2001 Myers
2002/0152775 A1 10/2002 Browder, Jr.
2003/0192351 A1 * 10/2003 Meckley ..... D04B 1/102 66/170
2006/0169004 A1 * 8/2006 Belluye ..... A41D 1/084 66/177
2006/0277950 A1 * 12/2006 Rock ..... A41D 13/002 66/169 R
2008/0120757 A1 5/2008 Nakazawa
2008/0189824 A1 * 8/2008 Rock ..... D04B 1/02 2/69
2010/0130903 A1 5/2010 Rock
2011/0257575 A1 10/2011 Farrow et al.
2011/0302686 A1 12/2011 Chapuis
2012/0117706 A1 5/2012 Tateo
2012/0174282 A1 7/2012 Newton et al.
2013/0186150 A1 7/2013 Pilawa et al.
2013/0254971 A1 10/2013 Galluzzo et al.
2014/0000005 A1 * 1/2014 Berns ..... A41D 13/1263 2/79
2014/0075656 A1 3/2014 Chang
2014/0082815 A1 3/2014 Harber et al.
2014/0289924 A1 10/2014 Cleveland
2014/0366585 A1 * 12/2014 Shen ..... A41D 13/0015 66/175
2015/0025435 A1 1/2015 Sherman
2015/0051524 A1 2/2015 Messier
2015/0224011 A1 8/2015 Scott et al.
2016/0150835 A1 6/2016 Salmini et al.
2016/0338417 A1 11/2016 Kehler et al.
2016/0339286 A1 11/2016 Kehler et al.
2018/0035727 A1 2/2018 Cumiskey et al.
2018/0279694 A1 10/2018 Theno et al.

FOREIGN PATENT DOCUMENTS

CN 203072932 U 7/2013
CN 103747695 A 4/2014
EP 0964091 A2 12/1999
EP 2543267 A1 1/2013
FR 2958535 A1 10/2013
GB 803083 A * 10/1958 ..... D04B 11/20
GB 2117805 A 10/1983
JP H05125601 A 5/1993
JP H11158704 A 6/1999
WO WO 2009135474 A1 * 11/2009 ..... A41D 1/084
WO 2012164300 A1 12/2012

OTHER PUBLICATIONS

International Preliminary Report on Patentability dated Dec. 7, 2017 in International Patent Application No. PCT/US2016/031493, 9 pages.
International Preliminary Report on Patentability dated Dec. 7, 2017 in International Patent Application No. PCT/US2016/031495, 9 pages.
International Search Report and Written Opinion dated Jul. 20, 2016 in International Patent Application No. PCT/US2016/031493, 13 pages.
International Search Report and Written Opinion dated Jul. 20, 2016 in International Patent Application No. PCT/US2016/031495, 13 pages.
"Textured Leggings" gobellygowear.com Last accessed Feb. 25, 2015 http://shop.gobellygowear.com/TexturedLeggingsTEXTURE.htm.
"Maruska Tights" anthropologie.com Last accessed Feb. 25, 2015 http://us.anthropologie.com/anthro/product/26072843.jsp#/.
"1x1 rib texture merino wool knit tights double gusset yellow" Last accessed Feb. 25, 2015 https://www.robaversand.com/en/11ribtexturemerinowoolknittightsdoublegussetyellow.html.
International Search Report with Written Opinion dated Jul. 20, 2016 in International Application No. PCT/US2016/031493, 13 pages.
Office Action dated Jun. 29, 2018 in U.S. Appl. No. 15/151,916, 14 pages.
Final Office Action dated Sep. 20, 2018 in U.S. Appl. No. 15/151,924, 8 pages.
Communication pursuant to Article 94(3) dated Dec. 6, 2018 in European Patent Application No. 16725007.5, 5 pages.
Final Office Action dated Dec. 11, 2018 in U.S. Appl. No. 15/151,916, 10 pages.
Notice of Allowance dated Dec. 12, 2018 in U.S. Appl. No. 15/151,924, 6 pages.
Notice of Allowance dated Feb. 27, 2019 in U.S. Appl. No. 15/151,916, 8 pages.
Communication pursuant to Article 94(3) dated May 31, 2019 in European Patent Application No. 16723909.4, 4 pages.

* cited by examiner

RUNNING TIGHT WITH PRECONFIGURED COMPRESSION ZONES AND INTEGRATED STRUCTURE PATTERNS

CROSS-REFERENCE TO RELATED APPLICATIONS

This application having U.S. application Ser. No. 15/151,928, entitled "Running Tight with Preconfigured Compression Zones and Integrated Structure Patterns," and filed May 11, 2016, is a Non-Provisional Application claiming priority to U.S. Prov. App. 62/165,480, entitled "Running Tight with Preconfigured Compression Zones and Integrated Structure Patterns," and filed May 22, 2015. The entirety of the aforementioned application is incorporated by reference herein.

This application having U.S. application Ser. No. 15/151,928, entitled "Running Tight with Preconfigured Compression Zones and Integrated Structure Patterns," and filed May 11, 2016, is related by subject matter to concurrently filed U.S. application Ser. No. 15/151,924, entitled "Training Tight with Preconfigured Compression Zones and Integrated Structure Patterns," and filed May 11, 2016, and U.S. application Ser. No. 15/151,916, entitled "Recovery Tight with Preconfigured Compression Zones and Integrated Structure Patterns," and filed May 11, 2016. The entireties of the aforementioned applications are incorporated by reference herein.

FIELD

The present disclosure relates to a running tight having preconfigured compression zones.

BACKGROUND

Running is a high-impact sport that imparts significant muscle vibration to the large muscle groups in the legs—namely the muscle groups in the thigh area and the calf area—when the runner's foot strikes the ground. Some consequences of this may include small micro-tears in the muscle groups and/or swelling, both of which may lead to muscle fatigue, edema, soreness, and a possible decrease in athletic performance. Traditional running apparel is generally configured to have moisture-management properties and to be lightweight, breathable, and non-constricting. However, traditional running apparel largely fails to address the problems noted above.

BRIEF DESCRIPTION OF THE DRAWINGS

Examples of the present invention are described in detail below with reference to the attached drawing figures, wherein.

DETAILED DESCRIPTION

Figure 2:
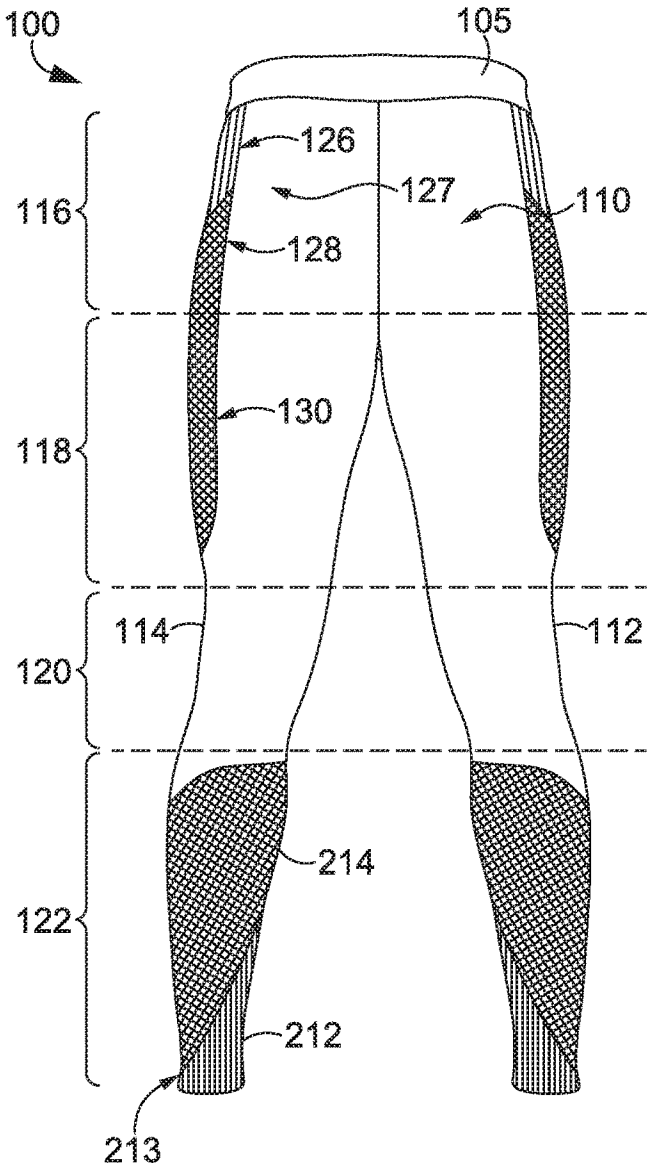
FIG. 2 illustrates a back view of the exemplary running tight with preconfigured compression zones and integrated structure patterns of FIG. 1 in accordance with an aspect herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed toward a warp knit running tight having preconfigured compression zones with different compressive properties. The different compressive properties of the zones may be achieved by varying the modulus of elasticity of the yarns used to form the zones, and/or by varying the modulus of elasticity of the fabric through yarn placement, and/or by using integrated knit structure patterns that modify the compressive properties of the zones in areas where the patterns are located. The running tights are configured such that a relatively high amount of compression is distributed over the thigh and calf area of a wearer and a relatively low amount of compression is distributed over the knee and hip area of the wearer when the running tight is worn. The amount of compression applied to a localized area on the wearer may be fine-tuned through use of the integrated knit structure patterns. These patterns generally comprise a plurality of offset areas created by shortening the length of the stitch used in this area. By shortening the stitch length, the modulus in the offset area is increased. The result of the configuration described is that vibration is minimized in the large muscle groups of the thigh and calf while a high degree of mobility is maintained in the knee and hip area.

Aspects herein may further relate to a method of manufacturing a running tight. The method may comprise, for example, preparing a warp knitting machine (single or double bar Jacquard) to utilize different elastic yarns having different moduli of elasticity in the warp where the yarns having different moduli of elasticity correspond to the different zones discussed above. Continuing, the method may further comprise programming the warp knitting machine based on a preconfigured placement pattern of the integrated knit structures. Next, a fabric is warp knitted and one or more pattern pieces are cut from the fabric. The pattern pieces are then affixed together to form the running tight. Additional steps may comprise dyeing and finishing the tight. In aspects, the dyeing and finishing may occur prior to cutting and affixing the pattern pieces together. Tights formed through this type of warp knitting process exhibit four-way stretch allowing them to closely conform to the wearer's body when worn. Moreover, materials used to form the tights are selected to provide breathability, moisture-management properties, and opacity to the tight.

Accordingly, aspects herein are directed to a running tight comprising a plurality of compression zones, where each of the plurality of compression zones has a modulus of elasticity value within a predefined range, and where one or more of the plurality of compression zones has an integrated structure pattern that modifies the modulus of elasticity value of the respective compression zone.

In another aspect, aspects herein provide a running tight comprising a first compression zone having a first modulus of elasticity value within a predefined range, where the first compression zone is located at an upper portion of the running tight. The running tight further comprises a second compression zone having a second modulus of elasticity value within a predefined range, where the second compression zone is located adjacent to and inferior to the first compression zone and a third compression zone having a third modulus of elasticity value within a predefined range, where the third compression zone located adjacent to and inferior to the second compression zone. The running tight also comprises a fourth compression zone having a fourth modulus of elasticity value within a predefined range, where the fourth compression zone is located adjacent to and inferior to the third compression zone, and where one or more of the first, second, third, and fourth compression zones comprises one or more integrated structure patterns that modify the modulus of elasticity value of the respective compression zone.

In yet another aspect, aspects herein provide a warp knitted running tight comprising a first set of compression zones having a first modulus of elasticity value within a predefined range; and a second set of compression zones having a second modulus of elasticity value within a predefined range. In aspects, the second modulus of elasticity value is greater than the first modulus of elasticity value. Further, in aspects, the first and second sets of compression zones comprise a plurality of integrated knit structure patterns that modify the modulus of elasticity value of the respective sets of compression zones.

As used throughout this disclosure, the term "elastic yarn" is meant to encompass both natural and synthetic yarns, fibers, and/or filaments that have the ability to be stretched and to return to their original form or length. Exemplary elastic yarns, fibers, and/or filaments include Lycra, thermoplastic polyurethane (TPU), elastane, rubber, latex, spandex, combinations thereof, and the like. The elastic yarns may be used by themselves to form the tights, or they may be combined with other types of yarns or fibers such as cotton, nylon, rayon, wool, polyester, or other fiber types to form the tights. In one exemplary aspect, these non-elastic yarns may comprise 50 denier polyester yarns. Further, as used throughout this disclosure, the term "modulus of elasticity" may be defined as a measure of an object's resistance to being deformed elastically when a force is applied to it. Modulus values, as described herein, are measured at 30% stretch across the width of the tight by ASTM D4964 and are expressed in pound-force (lbf). The term "compression force" as used herein is a measure of the pushing or pressing force that is directed toward the center of an object. The compression force is measured by a Salzmann Device and is expressed as a surface pressure value in mmHg.

Further, as used throughout this disclosure, the term "tight" may be defined as an article of clothing that closely conforms to the body contours of a wearer. This may be achieved by, for instance, incorporating elastic yarns into the tight as explained above. The term tight may refer to a full legging, a capri-style tight, a half-tight, a three-quarter tight, or a pair of shorts. In exemplary aspects, the tight may comprise a base layer worn under other layers of clothing. However, it is also contemplated herein that the tight may be worn by itself (i.e., not covered by other layers).

Figure 1:
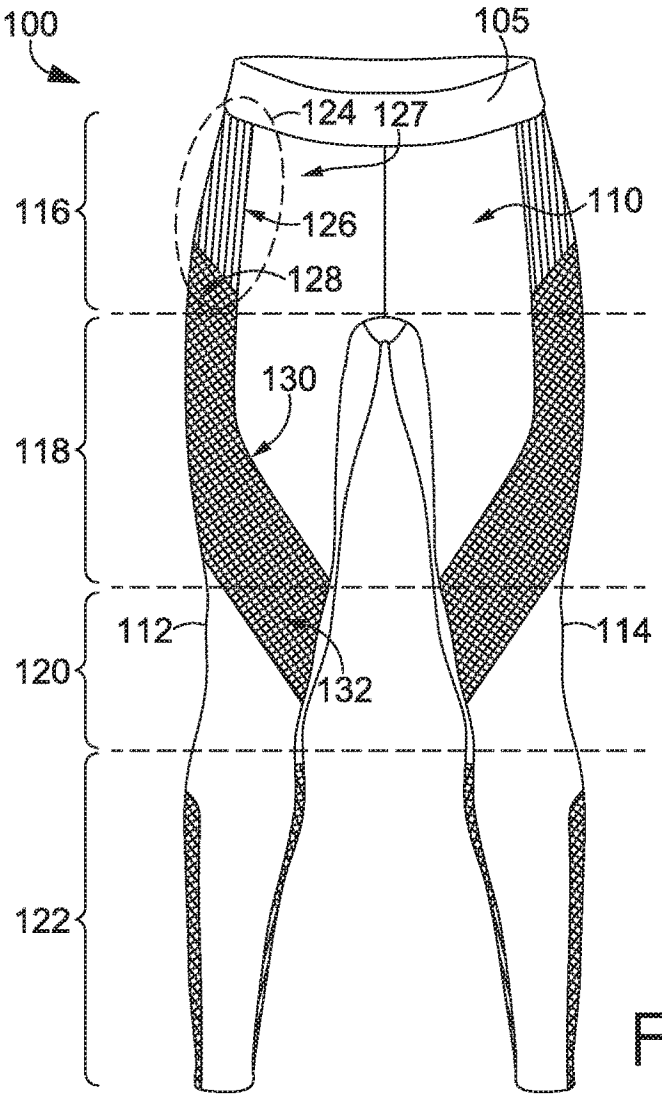
FIG. 1 illustrates a front view of an exemplary running tight with preconfigured compression zones and integrated structure patterns in accordance with an aspect herein.

Turning now to FIG. 1, a front view of an exemplary running tight 100 having compression zones and integrated knit structure patterns is depicted in accordance with an aspect herein. In exemplary aspects, the running tight 100 may be formed from a textile or panel knitted using a single bar Jacquard warp knitting process. The running tight 100 may comprise an optional waistband 105 affixed to a lower torso portion 110 of the tight 100, where the lower torso portion 110 is adapted to cover a lower torso of a wearer when the tight 100 is worn. The running tight 100 may further comprise a first leg portion 112 and a second leg portion 114 adapted to cover the legs of the wearer when the tight 100 is worn. Although shown as a full legging, it is contemplated that the running tight 100 may be in the form of a capri-type style, a half-tight, a three-quarter tight, or a short.

In exemplary aspects, the tight 100 may be divided into four compression zones, 116, 118, 120, and 122 where at least two or more of the compression zones may exhibit different compressive properties. In exemplary aspects, the four compression zones 116, 118, 120, and 122 may be in a generally horizontal orientation on the tight 100 due to the single bar Jacquard warp knitting process. It is contemplated that the running tight may include more or less than four compression zones. The use of the term "compression zone" is meant to convey the functional characteristics of a particular area of the tight 100 and is not meant to imply a specific shape, size, color, pattern, or orientation. For example, the running tight 100 may visually appear to have a generally uniform surface with no clear demarcation between the different zones.

The different compressive properties of the compression zones 116, 118, 120, and 122 may be created by, for example, using elastic yarns of differing diameter or differing denier in the warp. Elastic yarns having a higher denier or larger diameter will generally have a higher modulus of elasticity as compared to yarns having a smaller denier or a smaller diameter. Elastic yarns contemplated herein may have deniers ranging from, for example, 20 denier up to 160 denier. In an exemplary aspect, the compressive property of a particular zone may be created by using elastic yarns all having the same denier. For instance, 40 denier yarns may be used to knit a compression zone having a generally low modulus of elasticity, while 70 denier yarns may be used to knit a compression zone having a generally medium modulus of elasticity. In another exemplary aspect, the compressive property of a zone may be created by combining elastic yarns having different deniers. As an example, 40 denier yarns may be used with 70 denier yarns (for a combined denier of 110) to knit a compression zone having a generally high modulus of elasticity. Other combinations of deniers are contemplated herein. For instance, for compression zones having a generally medium to high compression force or modulus of elasticity, other combinations may comprise 20 denier yarns with 60 denier yarns for a combined denier of 80, 30 denier yarns with 50 denier yarns for a combined denier of 80, 40 denier yarns with 40 denier yarns for a combined denier of 80, and the like. Any and all such aspects, and any variation thereof, are contemplated as being within the scope herein.

In exemplary aspects, the first zone 116 generally extends from an upper margin of the tight 100 to the upper margin of the leg portions 112 and 114 (i.e., approximately one-quarter the length of the tight 100 as measured from the upper margin). In exemplary aspects, the first zone 116 may be constructed to have a modulus of elasticity in the range of 0.02 lbf to 0.75 lbf, or 0.06 lbf to 0.53 lbf. The compression force associated with the first zone 116 may be generally less than 10 mmHg.

In exemplary aspects, the first zone 116 may have a first integrated knit structure pattern 124. As mentioned, the compression force and/or modulus associated with a particular compression zone, such as the first zone 116, may be modified by use of knit structure patterns that are integrally formed from the same yarns used to knit the compression zones. The knit structure pattern generally comprises a pattern of offset, depressed areas in the fabric (areas of the fabric that extend inwardly away from the outer-facing surface plane of the tight 100). In exemplary aspects, these offset, depressed areas surround and define different structures. For example, the structures may comprise a series of lines created when the offset, depressed areas define a plurality of lines. In another example, a shape pattern may be created when the offset, depressed areas define a plurality of geometric shapes such as diamonds, squares, chevrons, and the like. In some exemplary aspects, the offset, depressed areas themselves may form shapes such as circles, diamonds, square, and the like, and the remaining portions of the tight, such as remaining areas 127, surrounds these offset shapes. Any and all such aspects, and any variation thereof, are contemplated as being within the scope herein.

The integrated knit structure patterns are created by, for instance, changing the length of the knit stitches. For example, a shorter stitch may be used to knit the offset, depressed areas of the pattern. Because a shorter stitch is used, these depressed areas typically exhibit less stretch due to less yarn and/or shorter floats in the stitch. And because these areas exhibit less stretch, the modulus of elasticity and/or compression force associated with these offset areas is increased. Thus, in general, the modulus of elasticity or compression force associated with the knit structure patterns is greater than the modulus of elasticity in the areas where the knit structure patterns are not located. To state this differently, the offset areas within the integrated structure pattern have a higher modulus of elasticity value compared to remaining areas within the compression zones without the integrated structure patterns.

Figure 4:
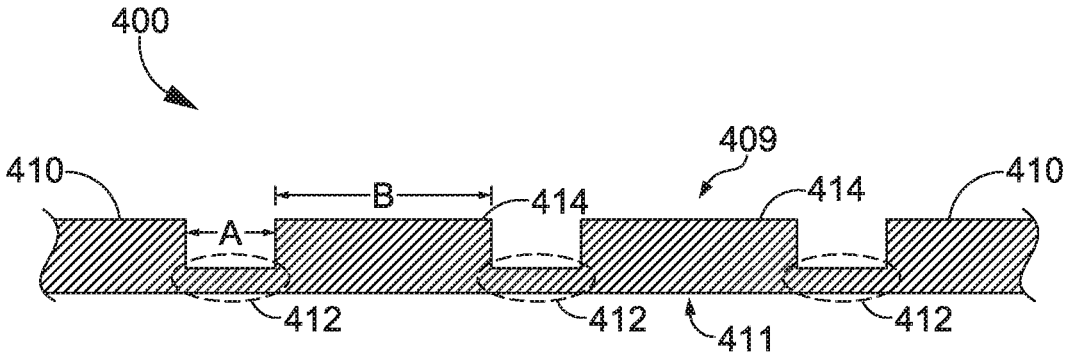
FIG. 4 illustrates a cross-section of an exemplary running tight taken at the location of an integrated structure pattern in accordance with an aspect herein.

A depiction of a cross-section of a fabric having an integrated knit structure pattern, referenced generally by the numeral 400, is illustrated in FIG. 4 in accordance with an aspect herein. In exemplary aspects, the fabric having the integrated knit structure pattern 400 may be incorporated into a tight, such as the running tight 100. As such, the reference numeral 410 indicates the portion of the tight on either side of or surrounding the integrated knit structure pattern 400. The offset, depressed areas created by using the shorter length stitch are indicated by the reference numeral 412. As shown, the areas 412 are offset from or extend inwardly from an outer-facing surface 409 of the tight and have a width "A." As shown in FIG. 4, an inner-facing surface 411 of the tight is planar. In exemplary aspects, the width A of the offset areas 412 may range from 0.5 mm up to 10 mm. In exemplary aspects, the offset areas 412 may delineate, space apart, and/or define a set of structures 414 having a width "B." The width B of the structures 414 may range from 0.5 mm up to 10 mm. The structures 414 are knit with generally the same stitch length as portions of the tight that do not have integrated structure patterns. As such, the "height" of the structures 414 generally align with the outer-facing surface plane of the tights. To put it another way, the structures 414 generally do not extend past the outer-facing surface plane of the tights. Depending on the pattern of the offset areas 412, the structures 414 may comprise lines or shapes such as those described with respect to FIGS. 5A-5S below. In another exemplary aspect, the offset areas 412 may themselves have a defined shape such as a circle, square, diamond, and the like. In this aspect, the non-offset areas of the tight surround and help to define these offset shapes. Any and all such aspects, and any variation thereof, are contemplated as being within the scope herein.

As described, the modulus of elasticity or compression force associated with a particular compression zone may be increased by use of integrated knit structure patterns such as the integrated knit structure pattern 400. The amount of increase may be tailored or customized by increasing and/or decreasing the percentage, surface area, or amount of the offset, depressed areas, such as the offset areas 412 of FIG. 4, in the particular knit structure pattern. As an example, by increasing the amount, percentage, or surface area of offset, depressed areas in a particular knit structure pattern, the compression force and/or modulus of elasticity in the knit structure pattern may be further increased. To describe it in a different way, the compression force and/or modulus of elasticity in a particular knit structure pattern may be further increased by increasing the spacing between adjacent structures in the pattern since the spacing corresponds to the offset areas (e.g., the spacing corresponds to the width A in FIG. 4). Conversely, by decreasing the amount, percentage, or surface area of offset, depressed areas in a particular knit structure pattern, the compression force and/or modulus associated with the knit structure pattern may be decreased relative to those areas of the pattern that have a higher percentage or surface area of offset areas. To put it another way, the compression force and/or modulus of elasticity in a particular knit structure pattern may be relatively decreased by decreasing the spacing between adjacent structures in the pattern.

Continuing, the orientation and/or direction of the offset areas within a particular knit structure pattern in relation to the tight as a whole may be used to modify the direction of the compression force and/or modulus of elasticity associated with the pattern. As an example, when the offset areas are in the form of lines, by orienting the offset lines in a generally vertical direction on the tight, the modulus associated with the pattern may be modified in a first vertical direction but be generally unmodified in a horizontal direction. However, by orienting the offset lines in the pattern in a generally horizontal direction, the modulus associated with the pattern may be modified in a second horizontal direction but be unmodified in the vertical direction. Any and all such aspects, and any variation thereof, are contemplated as being within aspects herein.

Figure 5A:
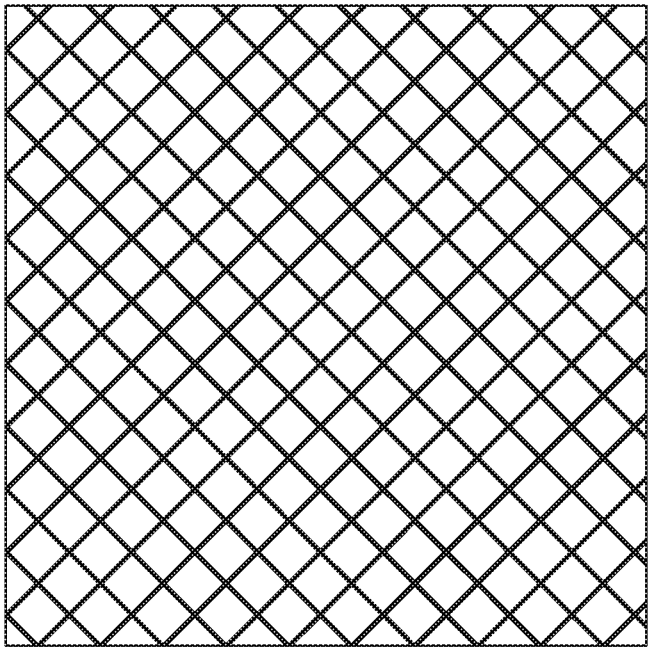
FIGS. 5A-5S illustrate exemplary configurations and exemplary spacings for the integrated structure patterns in accordance with aspects herein.
Figure 5B:
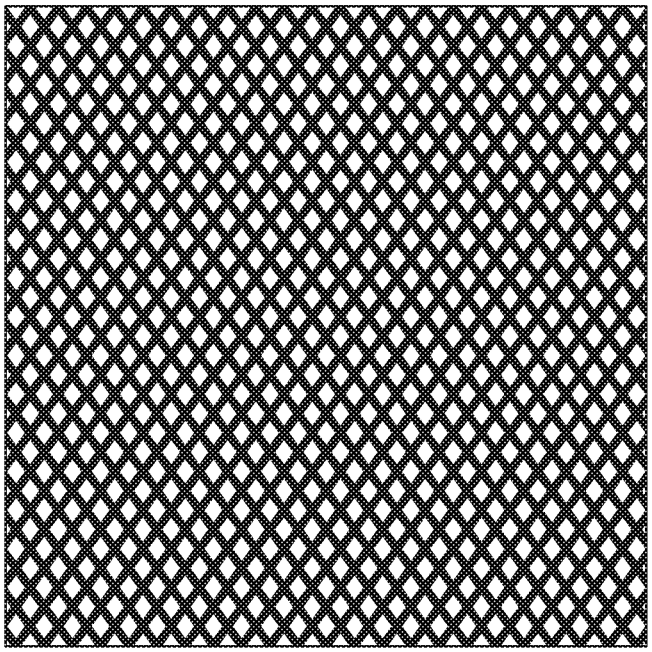
Figure 5C:
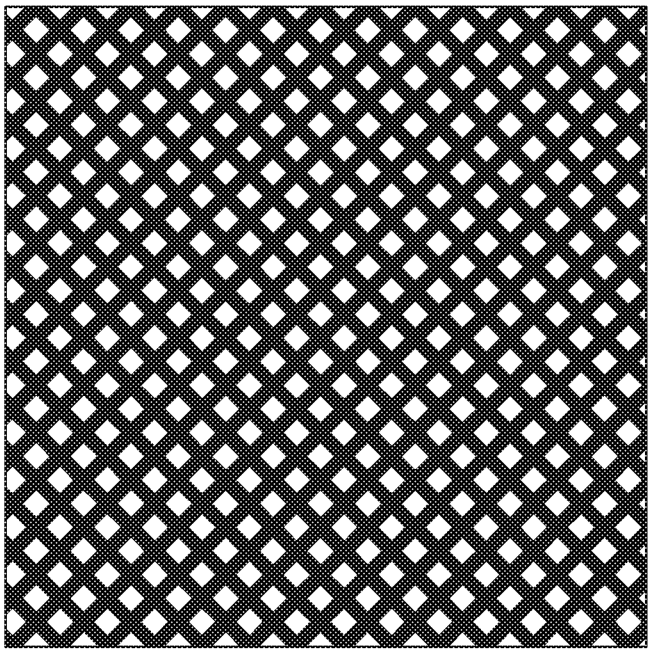
Figure 5D:
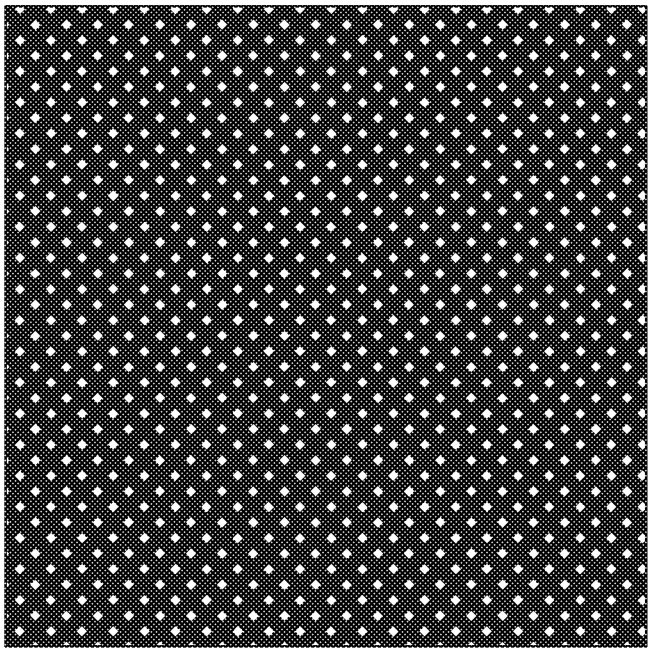
Figure 5E:
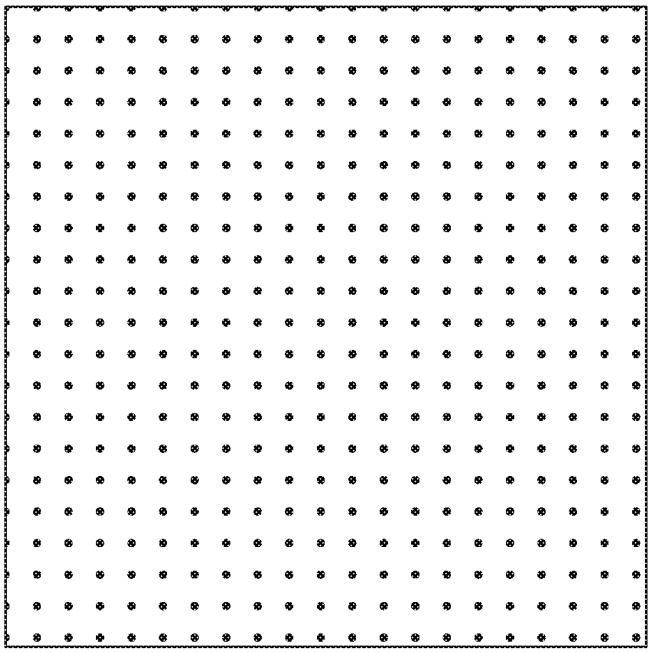
Figure 5F:
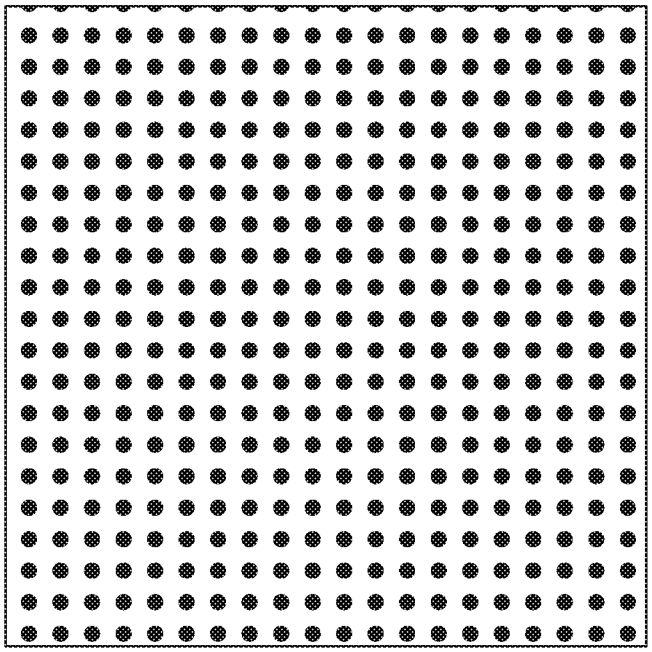
Figure 5G:
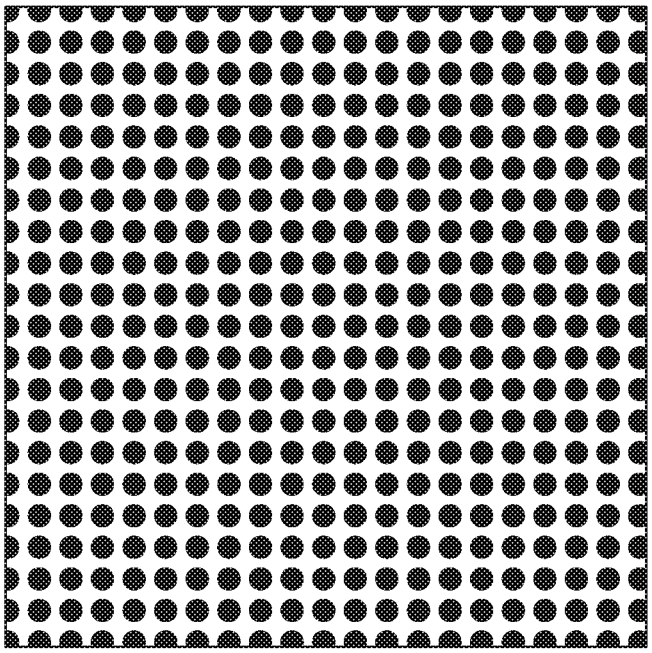
Figure 5H:
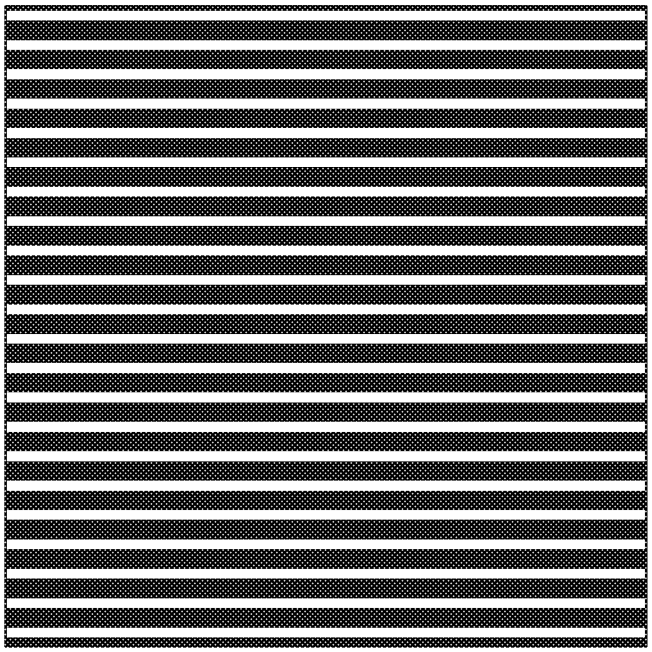
Figure 5I:
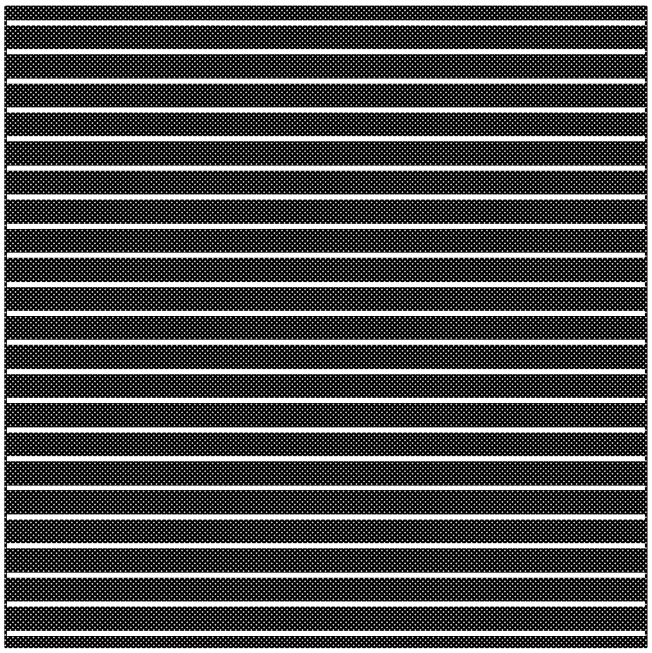
Figure 5J:
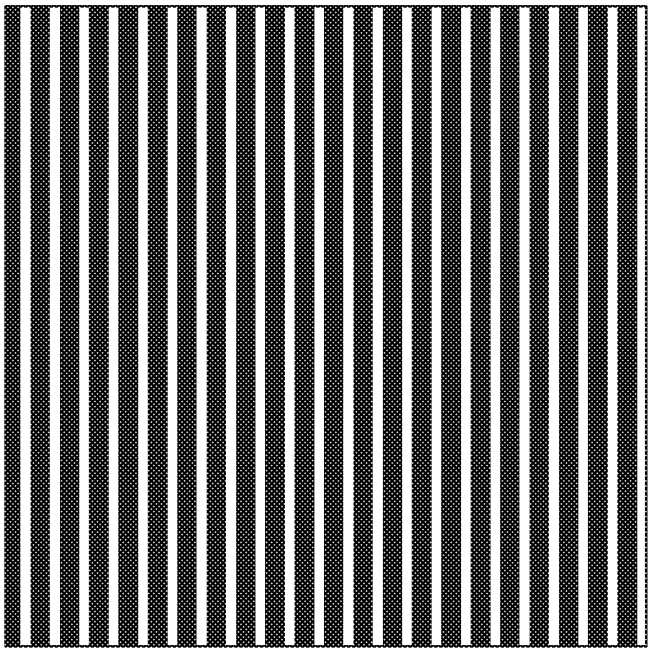
Figure 5K:
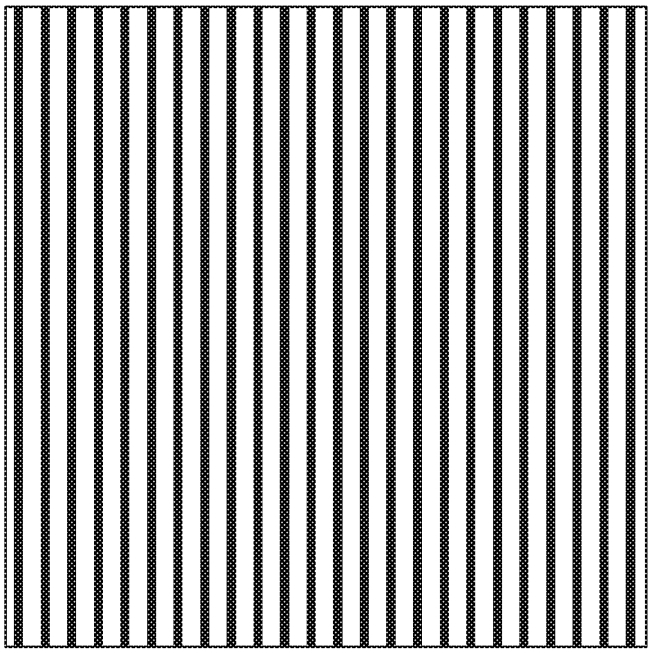
Figure 5L:
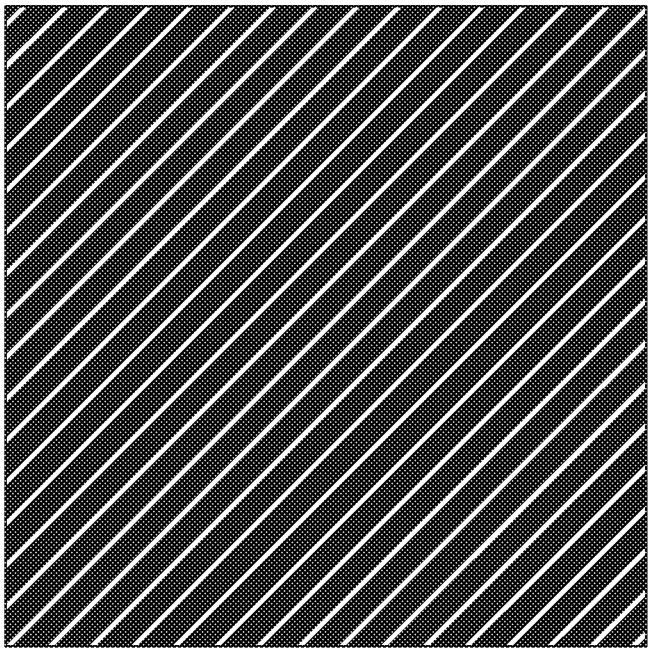
Figure 5M:
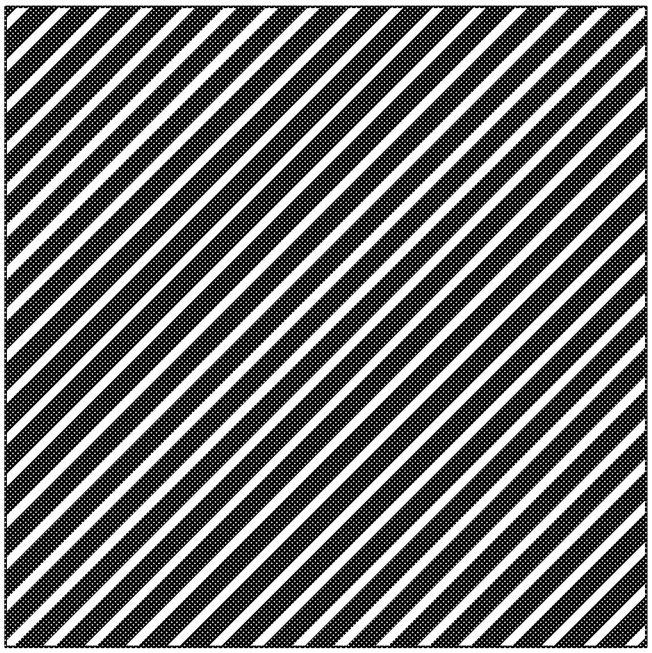
Figure 5N:
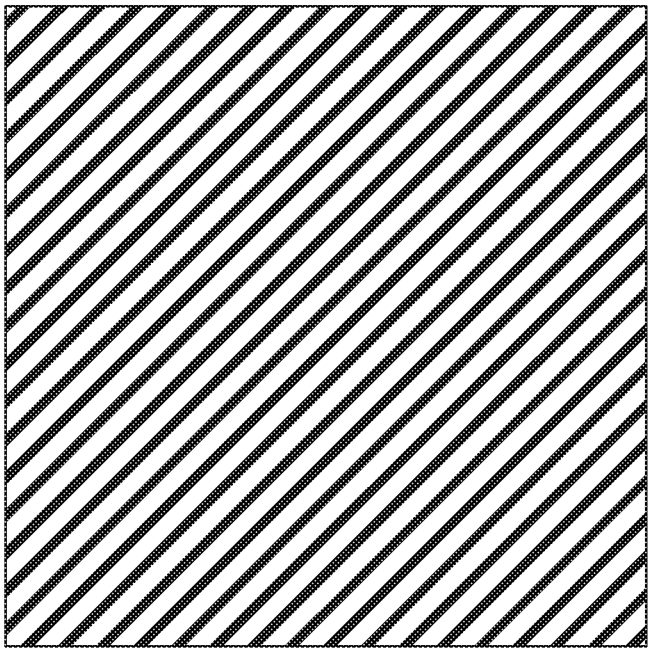
Figure 5O:
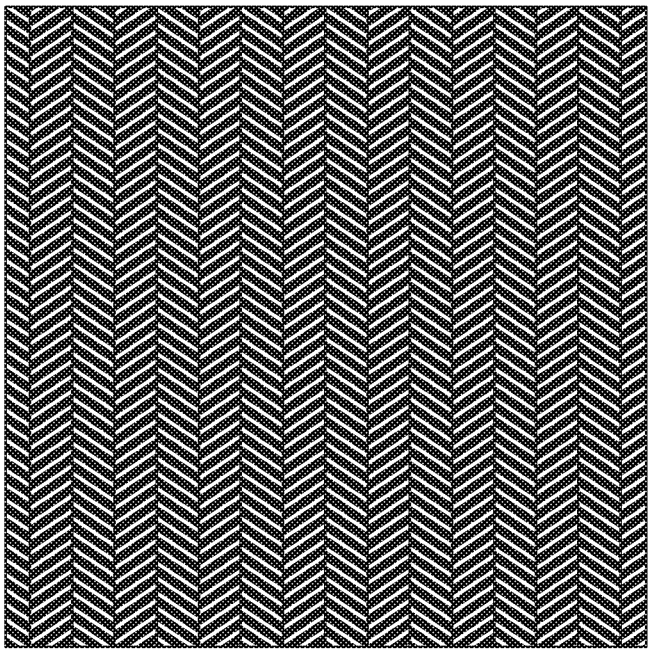
Figure 5P:
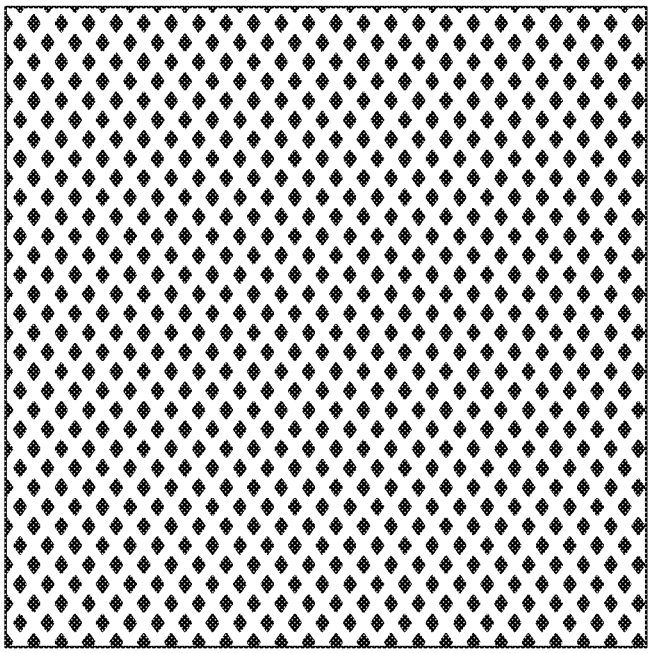
Figure 5Q:
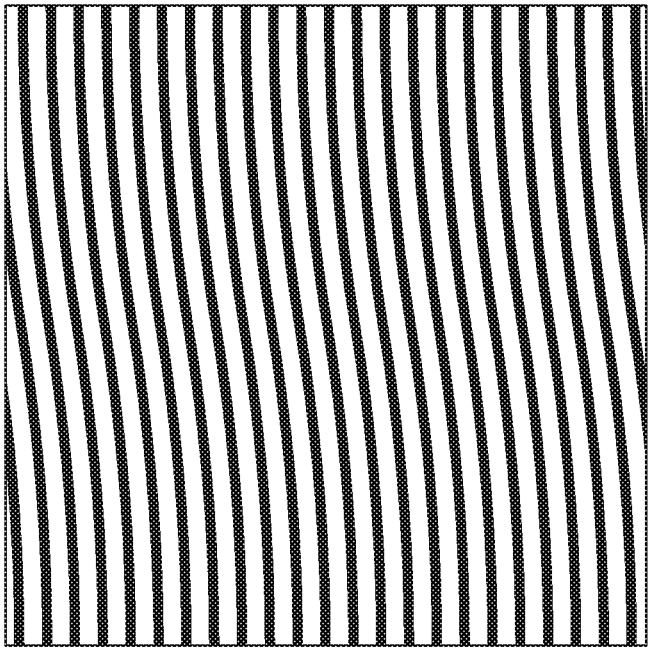
Figure 5R:
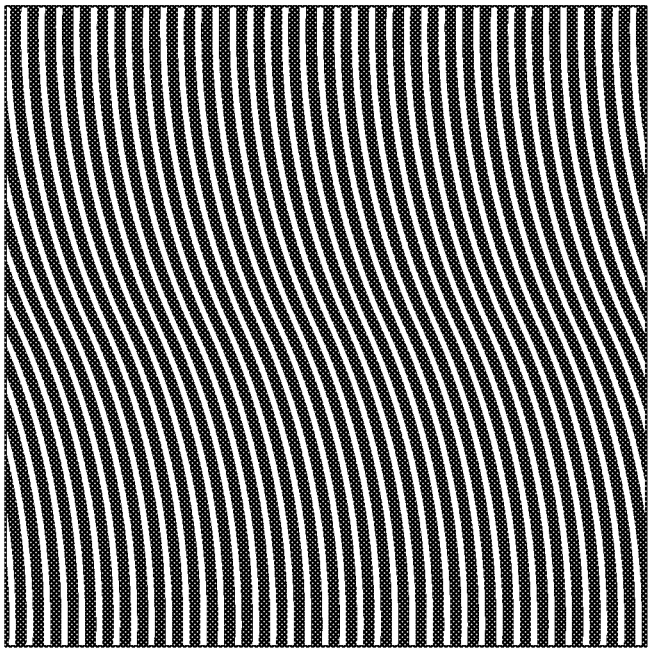
Figure 5S:
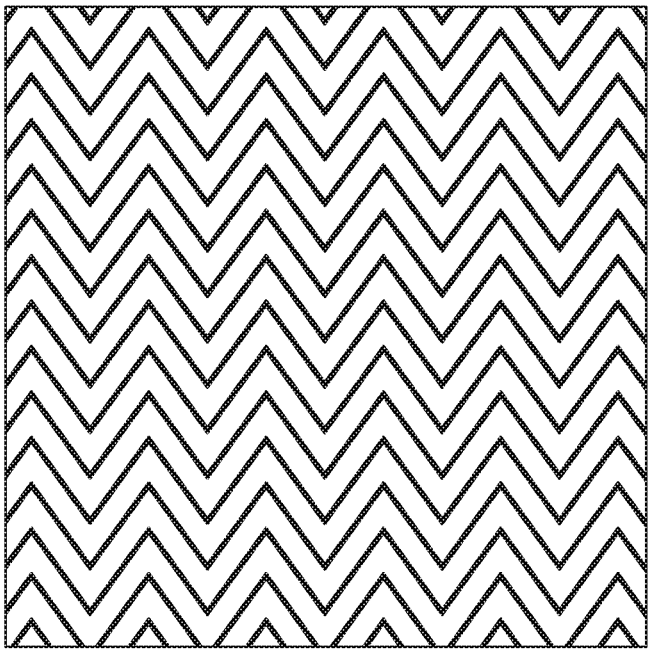

FIGS. 5A-5S illustrate a number of examples of integrated structure patterns as contemplated herein. The offset areas are shown in black and the structures defined by the offset areas are shown in white. For instance, FIGS. 5A-5D depict a series of diamond structures, where the spacing (e.g., the offset areas) between the diamonds gradually increases from FIG. 5A to FIG. 5D with a resultant decrease in size of the diamonds from FIG. 5A to FIG. 5D. Thus, the modulus and/or compression force associated with this pattern would increase from FIG. 5A to FIG. 5D.

FIGS. 5E-5G depict examples where the offset areas are in the form of circles and the remaining portion of the tight surrounds the circles. The size of the circles gradually increases from FIG. 5E to FIG. 5G, which would cause a corresponding increase in the modulus and/or compression force from FIG. 5E to FIG. 5G. Although circles are shown, it is contemplated herein that the offset areas may take other forms such as square, diamonds, triangles, and the like. FIGS. 5H and 5I depict a series of horizontal line structures, where the offset spacing between the lines increases from FIG. 5H to FIG. 5I with a resultant decrease in the width of the lines from FIG. 5H to FIG. 5I. Because the offset spacing in these patterns is oriented along a horizontal axis, the modulus and/or compression force would be increased along this axis.

Continuing, FIGS. 5J and 5K depict a series of vertical line structures, where the spacing between the lines decreases from FIG. 5J to FIG. 5K with a resultant increase in the width of the lines between these two figures. FIGS. 5L-5N depict a series of diagonal line structures, where the spacing between the lines decreases from FIG. 5L to FIG. 5N with a resultant increase in the width of the lines from FIG. 5L to FIG. 5N. FIG. 5O depicts a series of diagonal line structures oriented in different directions, and FIG. 5P depicts a configuration where the offset areas form diamond shapes. FIGS. 5Q-5R depict a set of curvilinear line structures separated by offset areas, where the spacing increases from FIG. 5Q to FIG. 5R with a resultant decrease in the size of the lines from FIG. 5Q to FIG. 5R. FIG. 5S depicts a series of zig-zag line structures separated by zig-zag offset spaces. Although not shown, the spacing between the zig-zag line structures may be increased or decreased with a resultant decrease or increase of the width of the zig-zag lines respectively.

As seen, the integrated knit structure patterns may take a variety of forms in order to achieve different functional purposes as outlined above. For example, by increasing the spacing between the structures (i.e., by increasing the percentage or surface area of the offset areas), a higher modulus and/or compression is achieved in the area of the tight where the pattern is located, and by decreasing the spacing between the structures (i.e., by decreasing the percentage or surface area of the offset areas), the modulus and/or compression force is reduced relative to areas of the pattern having increased spacing. Moreover, by orienting the pattern in certain directions, the modulus of elasticity may be altered along a long axis of the pattern. Using FIG. 5L as an example, by orienting the lines and offset areas along a diagonal axis, the modulus along that diagonal axis may also be increased.

Returning now to FIG. 1, in one exemplary aspect the first integrated structure pattern 124 may comprise a series of parallel lines 126 and a series of shapes 128 shown in the form of diamonds, where the lines 126 and the shapes 128 are defined by and separated from each other by offset, depressed areas having a shorter stitch and higher modulus (described above). Although shown as lines and diamonds, it is contemplated herein that any of the other configurations described above may be used. Any and all such aspects, and any variation thereof, are contemplated as being within the scope herein.

In exemplary aspects, the parallel lines 126 may be oriented in a generally vertical direction and may be located near the lateral margins of the running tight 100. As described earlier, the use of the lines 126 may increase the modulus of elasticity and/or compression force in the underlying area of the tight 100 in which the lines 126 are located as compared to areas of the tight 100 that do not have an integrated structure pattern. Further, by orienting the lines 126 is a generally vertical or near-vertical direction, the modulus may be increased along a vertical axis. In exemplary aspects, the modulus of elasticity and/or compression force may be increased by, for example, 2%, 5%, 10%, 15%, 20%, up to 25%, or up to 50%, or any value in between.

In exemplary aspects, the spacing between the lines 126 may be adjusted along a gradient to gradually modify the modulus along the gradient. With reference to FIG. 1, the lines 126 located closer to the midline of the tight 100 may be spaced further apart than the lines 126 located closer to the lateral margin of the tight 100. The spacing gradient between the lines 126 may cause the modulus of elasticity and/or compression force to be further increased by, for example, 1%, 2%, 5%, 7%, 10% up to 15% or any value in between with the larger changes being associated with the greater spacing. This spacing gradient may be helpful in providing a greater degree of compression over the lateral, front portion of the wearer's hip/thigh area when the tight 100 is worn and a lesser degree of compression over the lateral aspect of the wearer's hip area. Having a vertically-oriented increased modulus in this area may provide a beneficial level of added compression to some of the larger muscle groups in the thigh when the tight 100 is worn helping to minimize muscle vibration. This is especially true considering that this area comprises an insertion point for some of the larger muscle groups in the thigh and considering that these muscles are generally aligned in a vertical direction. The location and spacing associated with the lines 126 are exemplary only, and it is contemplated that other locations and other spacing gradients may be utilized in association with the tight 100.

The shapes 128 are positioned adjacent to and below the lines 126 towards the lateral margin of the tight 100. As described earlier, the use of this configuration may increase the modulus of elasticity and/or compression force in the underlying area in which the shapes 128 are located. In exemplary aspects, the modulus of elasticity and/or compression force may be increased by, for example, 2%, 5%, 10%, 20%, 30%, 40%, up to 50%, or any value in between.

Similar to the lines 126, the spacing between the shapes 128 may be adjusted along a gradient to gradually modify the modulus along the gradient. With reference to FIG. 1, the shapes 128 located closer to the midline of the tight 100 may be spaced further apart than the shapes 128 located closer to the lateral margin of the tight 100. The spacing gradient between the shapes 128 may cause the modulus of elasticity and/or compression force to be further increased by, for example, 1%, 2%, 5%, 7%, 10% up to 15% or any value in between with the greater increases being associated with the greater spacing. By positioning the shapes 128 as shown in FIG. 1 and by creating the spacing gradient as described, a greater level of compression may be achieved over, for example, the upper portion of the quadriceps muscle group. The location and spacing associated with the shapes 128 are exemplary only, and it is contemplated that other locations and other spacing gradients may be utilized in association with the tight 100. Moreover, it is contemplated herein that the first zone 116 may not comprise an integrated structure pattern. Any and all aspects, and any variation thereof, are contemplated as being within the scope herein.

Continuing, the second zone 118 generally extends from the lower margin of the first zone 116 to an area slightly above the knee area of the tight 100. In exemplary aspects, the second zone 118 may be constructed to have a modulus of elasticity in the range of 0.5 to 1.75, or 0.79 to 1.25 lbf. The compression force associated with the second zone 118 may be in the range of 10 to 20 mmHg.

In exemplary aspects, the second zone 118 may have an integrated structure pattern in the form of a set of shapes 130. The shapes 130 may comprise an extension of the shapes 128 associated with the first zone 116. In exemplary aspects, the shapes 130 may be positioned such that they gradually extend over the front or anterior portion of the tights 100 as the second zone 118 transitions to the third zone 120. In other words, when the tight 100 is in an as-worn configuration, the shapes 130 may be positioned to angle downwardly over the front of the wearer's thigh from a lateral to a medial aspect. In exemplary aspects, spacing between the shapes 130 may be along a gradient with increased spacing between the shapes located closer to the midline of the tight 100 and decreased spacing between the shapes 130 located closer to the lateral margins of the tights 100. The location and spacing associated with the shapes 130 are exemplary only, and it is contemplated that other locations and other spacing gradients may be utilized in association with the tight 100. Moreover, it is contemplated herein that the second zone 118 may not comprise an integrated structure pattern. Any and all aspects, and any variation thereof, are contemplated as being within the scope herein.

By configuring the second zone 118 to have a higher compression force than, for example, the first compression zone 116, a beneficial level of compression may be achieved over the quadriceps muscle group as well as the hamstrings thereby helping to minimize the effects of muscle vibration on these muscle groups during running or exercise. Moreover, by orienting the shapes 130 generally over the front portion of the tight 100 and by adjusting the spacing between the shapes 130 as described, an even greater amount of compression force is distributed over the quadriceps muscle group when the tight 100 is worn, as this muscle group may experience a greater degree of vibration compared to the hamstring muscle group due to the mechanics of a running stride.

In exemplary aspects, the third zone 120 may generally extend from the lower margin of the second zone 118 to an area slightly below the knee area of the tight 100. In exemplary aspects, the third zone 120 may be constructed to have a modulus of elasticity in the range of 0.02 lbf to 0.75 lbf, or 0.06 lbf to 0.53 lbf. The compression force associated with the third zone 120 may be generally less than 10 mmHg. It may be beneficial to have a lower amount of compression in this area as compared to, for instance, the second zone 118, as this area is subject to a high amount of extension and flexion when the tight 100 is worn. To put it another way, the third zone 120 is configured to be positioned adjacent to a knee area of a wearer when the tight 100 is worn. Having a low amount of compression in this area enables a greater freedom-of-movement which is important during a running motion.

In exemplary aspects, the third zone 120 may have an integrated structure pattern in the form of a set of shapes 132 that are an extension of the shapes 130 associated with the second zone 118. As such, the shapes 132 may continue to angle downward across a portion of the anterior aspect of the tight 100. However, in other exemplary aspects, the third zone 120 may not comprise an integrated structure pattern. Any and all aspects, and any variation thereof, are contemplated as being within the scope herein.

In exemplary aspects, the fourth zone 122 may generally extend from the lower margin of the third zone 120 to the lower or bottom margin of the tight 100. In exemplary aspects, the fourth zone 122 may be constructed to have a modulus of elasticity in the range of 0.5 to 1.75, or 0.79 to 1.25 lbf. The compression force associated with the second zone 118 may be in the range of 10 to 20 mmHg. In exemplary aspects, the fourth zone 122 may be generally devoid of an integrated knit structure pattern on the front-facing or anterior side of the tight 100.

With respect to FIG. 2, FIG. 2 illustrates a back view of the exemplary running tight 100 in accordance with aspects herein. The back view of the tight 100 may comprise the same zones 116, 118, 120 and 122 as were described in relation to FIG. 1. As such, location of the zones, the modulus of elasticity values, and the compression force values discussed in relation to FIG. 1 with respect to the zones are equally applicable here. However, the location of the integrated knit structure patterns on the back portion of the tight 100 may differ from the location of these structure patterns on the front portion of the tight 100 in exemplary aspects. For instance, the first, second, and third zones 116, 118, and 120 may be generally devoid of integrated knit structures on the posterior portion of the tights 100. However, it is contemplated herein that these zones may comprise integrated knit structures.

In exemplary aspects, the fourth zone 122 may comprise an integrated knit structure pattern on the back-facing side of the tight 100, where the structure pattern may comprises a series of lines 212 and a series of shapes 214. The shapes 214 may generally extend from the lower margin of the third zone 120 to a bottom margin of the tights 100. As described above, the shapes 214 may modify the compressive properties of the tight 100 by increasing the modulus in the areas where they are located. In exemplary aspect, spacing between adjacent shapes 214 may be along a gradient with decreased spacing in areas located near the upper margin of the fourth zone 122 and increased spacing (i.e., increased modulus) in areas towards the lower margin of the fourth zone 122. By having an increasing modulus gradient extending towards the lower margin of the fourth zone 122, an increased amount of compression is provided over the calf muscle of the wearer when the tight 100 is worn helping to minimize muscle vibration in this muscle group. This is augmented by the underlying compression force associated with the fourth zone 122. The location and spacing associated with the shapes 214 are exemplary only, and it is contemplated that other locations and other spacing gradients may be utilized in association with the tight 100. For example, in another exemplary aspect, the spacing between the shapes 214 may be greater (i.e., increased modulus) near the upper margin of the fourth zone 122, and the spacing may be decreased near the lower margin of the fourth zone 122. This may be useful in applying a greater compressive force over the main muscle body of the calf muscle when the tight 100 is worn. Any and all aspects, and any variation thereof, are contemplated as being within the scope herein.

In exemplary aspects, and as shown in FIG. 2, the lines 212 may extend from the lower margin of the shapes 214 and are longer in length towards the medial margin of the tight 100 and shorter in length towards the lateral margin of the tight 100. The lines 212 may be oriented in a generally vertical direction and may increase the modulus along a vertical axis. An increased modulus along the vertical axis corresponds to the generally vertical orientation of the calf muscles. In exemplary aspects, spacing between adjacent lines 212 may be decreased in areas located near the medial margins of the tight 100 and may be increased in areas located near the lateral margins of the tight 100. The location and spacing associated with the lines 212 are exemplary only, and it is contemplated that other locations and other spacing gradients may be utilized in association with the tight 100. Further, it is contemplated herein that the tights 100 may not comprise the lines 212.

When the tight 100 is configured as a short, capri, a half-tight, or three-quarter tight, the positioning of the zones 116, 118, 120, and 122 and their associated integrated knit structure patterns generally remains the same. One difference, however, is that the third and/or fourth zones 120 and 122 may be truncated resulting in a decreased length of these zones and a corresponding loss of some of the structure patterns. For example, the lines 212 and or shapes 214 may be truncated or even eliminated when forming the capri, three-quarter tight, or half-tight.

Figure 3A:
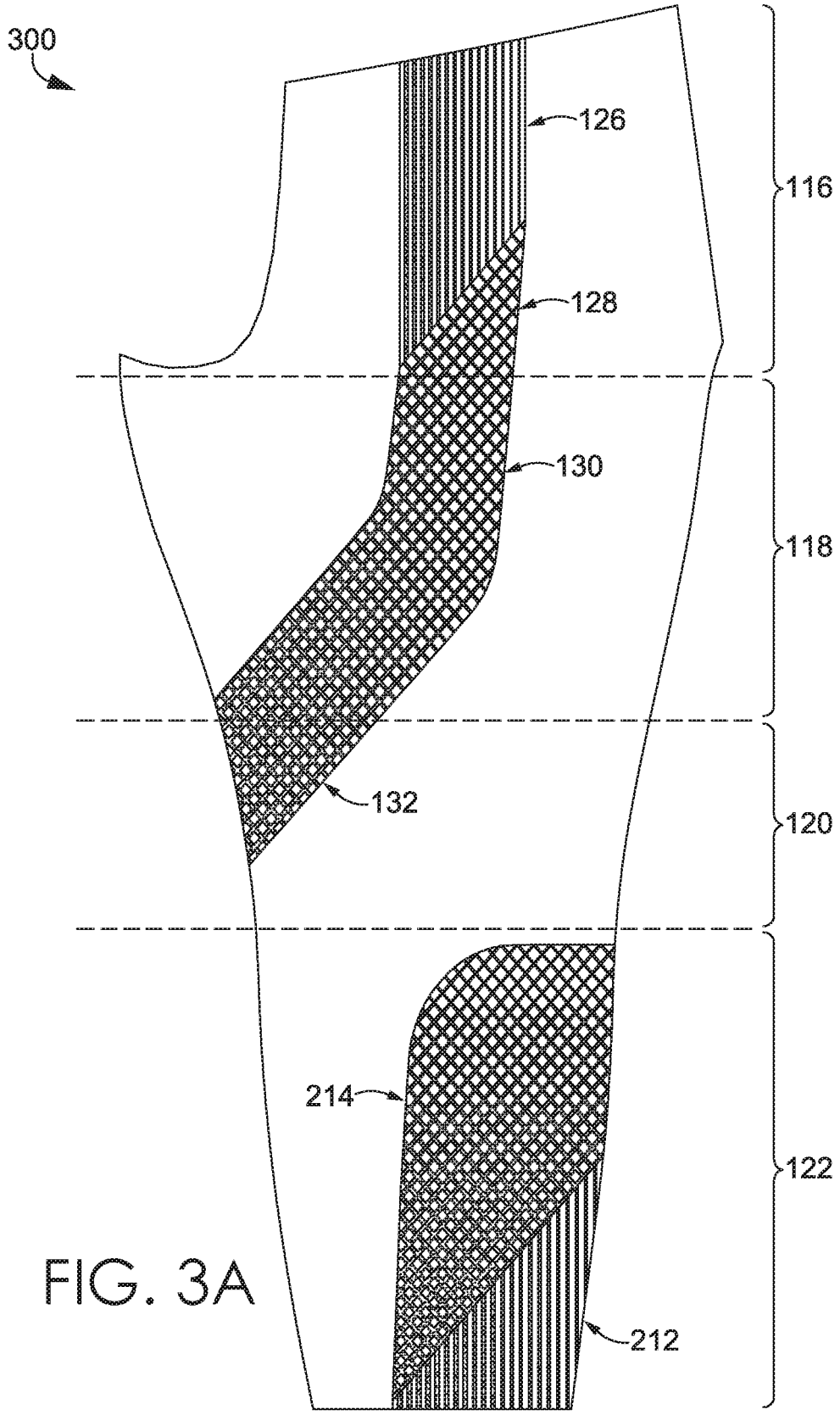
FIG. 3A illustrates a pattern piece used to construct the exemplary running tight of FIG. 1 in accordance with an aspect herein.

Turning now to FIG. 3A, a pattern piece 300 is depicted, where the pattern piece 300 may be cut from a panel of fabric knitted using, for instance, a single bar Jacquard warp knitting process. The panel of fabric may be knit to have the compression zones discussed above and the integrated structure patterns. The pattern piece 300 may be used in part to form the running tight 100. For instance, the pattern piece 300 may correspond to a pattern piece for a left leg portion and may be joined to a pattern piece for a right leg portion at one or more seams to form the tight 100. The pattern piece 300, moreover, may be cut to a number of different sizes so as to form different sizes of tights 100 and may be shaped differently to form tights for women versus men. Although the pattern piece 300 is shown with a length corresponding to a full tight, it is contemplated that the length may be shortened to form a capri, a half-tight, a three-quarter tight, or a short. The general location for the compression zones 116, 118, 120, and 122 is depicted along with the shapes/structures 126, 128, 130, 132, 212, and 214 as shown and described in relation to FIGS. 1 and 2. Moreover, the spacing between the structures that was described above with respect to FIGS. 1 and 2 is better shown in FIG. 3A.

Figure 3B:
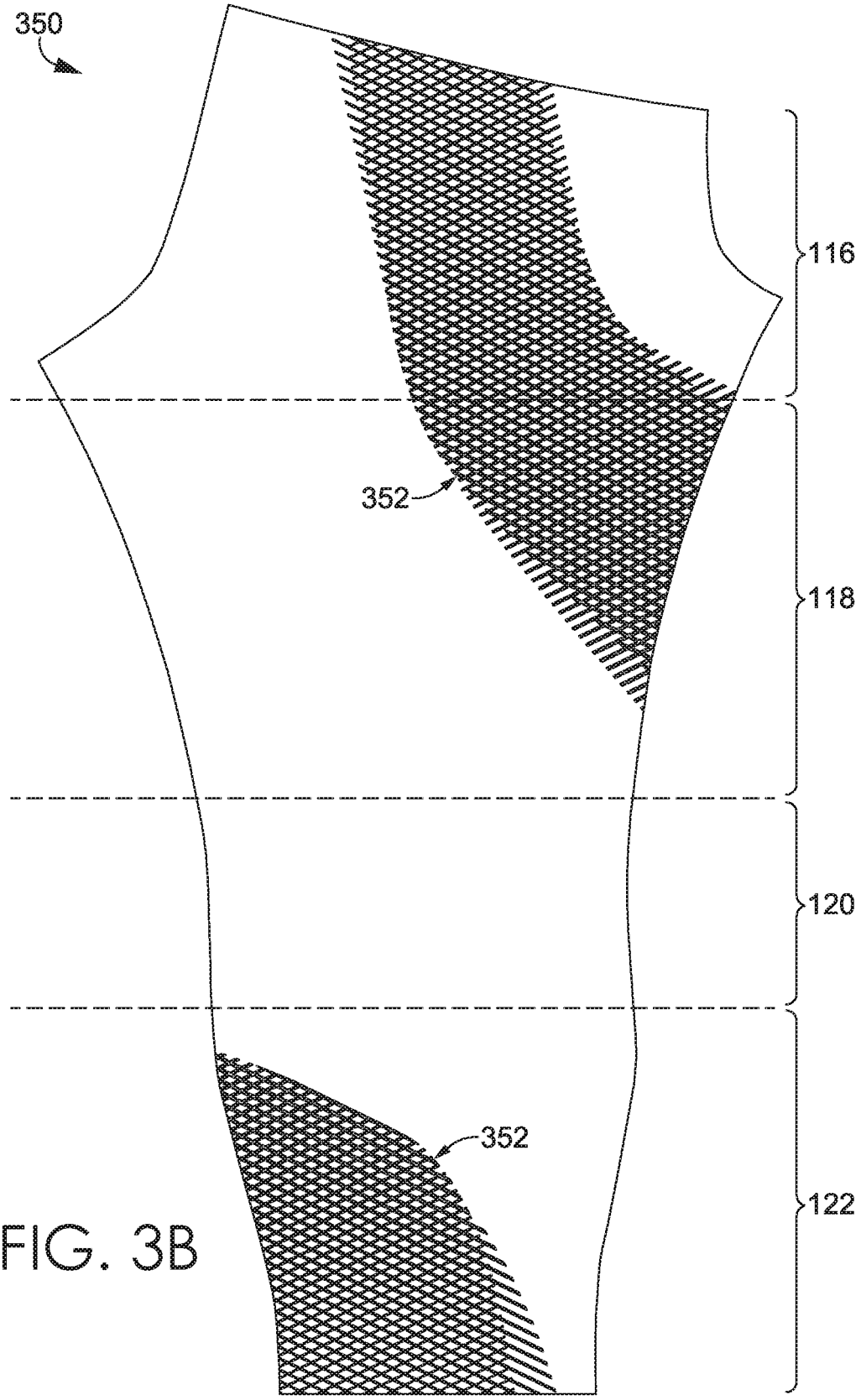
FIG. 3B illustrates an exemplary pattern piece used to construct an exemplary running tight having preconfigured compression zones and integrated structure patterns in accordance with aspects herein.

FIG. 3B illustrates another exemplary pattern piece 350 used to form a running tight having preconfigured compression zones Like the pattern piece 300, the pattern piece 350 may be cut from a panel of fabric knitted using, for example, a single bar Jacquard warp knitting process. The pattern piece 350 is generally similar to the pattern piece 300 with respect to the general location of the compression zones 116, 118, 120, and 122. However, the pattern piece 350 illustrates another exemplary configuration for integrated knit structure patterns 352. For instance, instead of utilizing line structures as described above with respect to, for instance, the first and fourth compression zones 116 and 122, the integrated knit structure patterns 352 generally comprise shapes, such as diamond shapes. Moreover, the pattern piece 350 may not comprise any integrated knit structure patterns 352 for the third compression zone 120. Continuing, unlike the pattern piece 300 where the spacing between the shapes 214 for the fourth compression zone 122 gradually increases from a superior to an inferior aspect, the inverse holds true for the pattern piece 350. In other words, the spacing between the shapes gradually decreases from superior to an inferior aspect of the pattern piece 350.

Although the zones 116, 118, 120, and 122 are shown in FIGS. 1-3B as generally comprising horizontally oriented bands formed through a single bar Jacquard warp knitting process, it is contemplated herein that the compression zones may comprise organically shaped (e.g., curvilinear) areas. As used in this disclosure, the term "organically shaped" generally means a shape having one or more curved or non-linear segments. For example, when textile panels used to form the exemplary running tight described herein are knit using a double bar Jacquard warp knitting process, one bar may be used to carry the elastic yarns that are used to impart the compression characteristics of the tight, while the other bar may be used to carry other yarns (e.g., polyester yarns) used to form the tights. The bar carrying the elastic yarns may be used to drop in stiches were needed to create more organically shaped compression zones. This may be useful in customizing compression zones for specific muscle groups as the shape of the compression zone can be tailored to the shape of the underlying muscle group.

Figure 10:
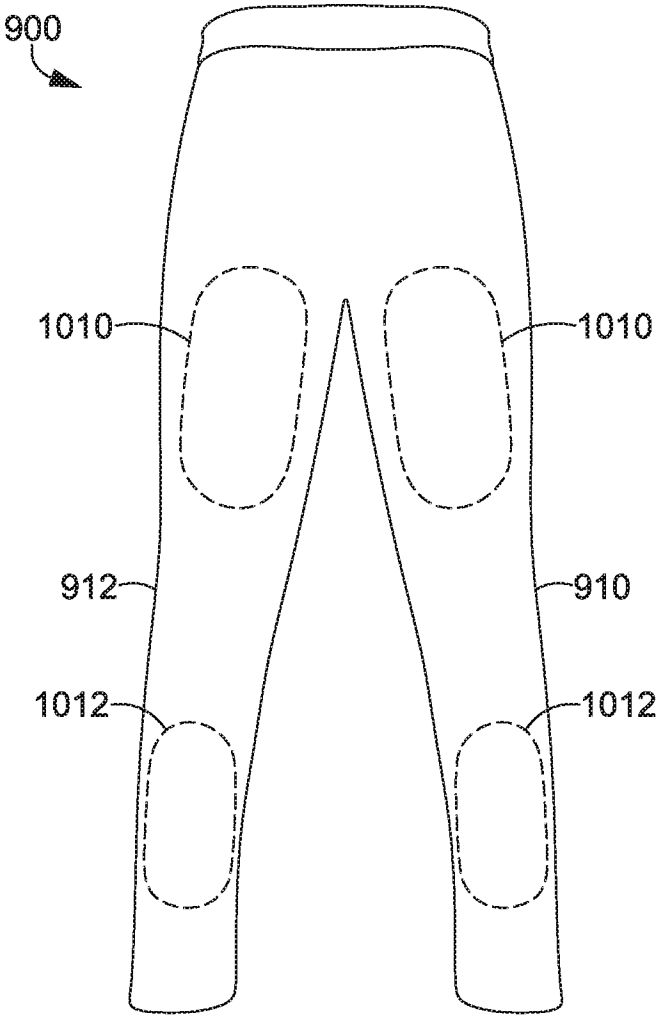
FIG. 10 illustrates a back view of the exemplary running tight of FIG. 9 in accordance with aspects herein.
Figure 9:
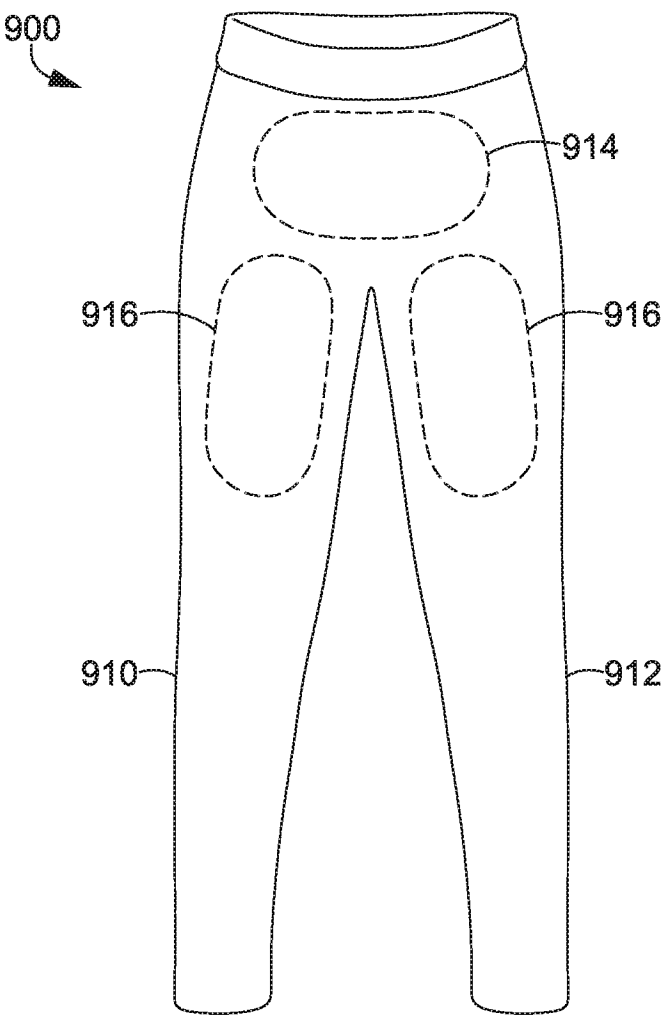
FIG. 9 illustrates a front view of an exemplary running tight with organically shaped compression zones in accordance with aspects herein.

An exemplary running tight incorporating organically shaped compression zones generated through, for instance, a double bar Jacquard warp knitting process is depicted in FIGS. 9 and 10 in accordance with aspects herein. FIG. 9 depicts a front view of an exemplary running tight 900, and FIG. 10 depicts a back view of the exemplary running tight 900. The running tight 900 may have a torso portion, and at least a first leg portion 910 and a second leg portion 912. With respect to FIG. 9, a low to medium modulus compression zone 914 (shown by dashed lines) may be located at an anterior aspect of the torso portion such that it generally is positioned adjacent to a lower abdomen area of a wearer when the tight 900 is worn. The modulus of elasticity values and compression force associated with the zone 914 may be the same or similar to those recited for the first and third compression zones 116 and 120 of the tight 100. Providing a moderate degree of compression in this area may help to impart core stability to the wearer when the tight 900 is worn.

Compression zones 916 are shown as generally being located at an anterior aspect of the tight 900 at an upper portion of the first leg portion 910 and the second leg portion 912. When the running tight 900 is worn, the compression zones 916 would be positioned adjacent to an upper anterior thigh area of the wearer. The modulus of elasticity values and compression force associated with the compression zones 916 may be the same or similar to those recited for the second and fourth compression zones 118 and 122 of the tight 100. Because the elastic yarns are dropped in where needed, the compression zones 914 may assume a more organic shape thereby allowing the compression zones 914 to provide a targeted compression to, for instance, the quadriceps muscle groups of the wearer. Although not shown, additional organically shaped compression zones may also be located over the knee area of the tight 900 and lower portions of the first and second leg portions 910 and 912. For instance, a compression zone located at the knee area may have a modulus of elasticity and/or compression force generally equal to that described for the first and third compression zones 116 and 120 of the tight 100. And a compression zone located at the lower portion of the first and second leg portions 910 and 912 may have a modulus of elasticity and/or compression force generally equal to that described for the second and fourth compression zones 118 and 122 of the tight 100. Any and all aspects, and any variation thereof, are contemplated as being within the scope herein.

FIG. 10, which depicts a back view of the tight 900 further depicts compression zones 1010 located at an upper posterior portion of the first leg portion 910 and the second leg portion 912. When worn, the compression zones 1010 would be positioned adjacent to an upper posterior thigh area of the wearer. The modulus of elasticity values and compression force associated with the compression zones 1010 may be the same or similar to those recited for the second and fourth compression zones 118 and 122 of the tight 100. Because the elastic yarns are dropped in where needed, the compression zones 1010 may assume a more organic shape thereby allowing the compression zones 1010 to provide a targeted compression to, for instance, the hamstring muscle groups of the wearer when the tight 100 is worn.

Compression zones 1012 may be positioned at a lower posterior portion of the first leg portion 910 and the second leg portion 912. When worn, the compression zones 1012 would be positioned adjacent to the calf muscles of the wearer. The modulus of elasticity values and compression force associated with the compression zones 1012 may be the same or similar to those recited for the second and fourth compression zones 118 and 122 of the tight 100. Because the elastic yarns are dropped in where needed, the compression zones 1012 may assume a more organic shape thereby allowing the compression zones 1012 to provide a targeted compression to, for instance, the calf muscles of the wearer. Although not shown, additional organically shaped compression zones may also be located over the posterior lower torso portion of the tight 900 and posterior knee portions of the first and second leg portions 910 and 912. For instance, a compression zone located at the posterior lower torso portion of the tight 900 and compression zones located at the posterior knee portions of the first and second leg portions 910 and 912 may have a modulus of elasticity and/or compression force generally equal to that described for the first and third compression zones 116 and 120 of the tight 100. Any and all aspects, and any variation thereof, are contemplated as being within the scope herein.

Although not shown, it is contemplated herein that integrated knit structure patterns may be associated with the compression zones 914, 916, 1010, and 1012 of the tight 900 to modify the compression force of the compression zones as desired. It is further contemplated herein that the shape configuration for the compression zones may differ from that shown in FIGS. 9 and 10. Moreover, it is contemplated herein that the tight 900 may comprise additional compression zones than those shown, or may comprise fewer compression zones than those shown. Any and all aspects, and any variation thereof, are contemplated as being within aspects herein.

Figure 6:
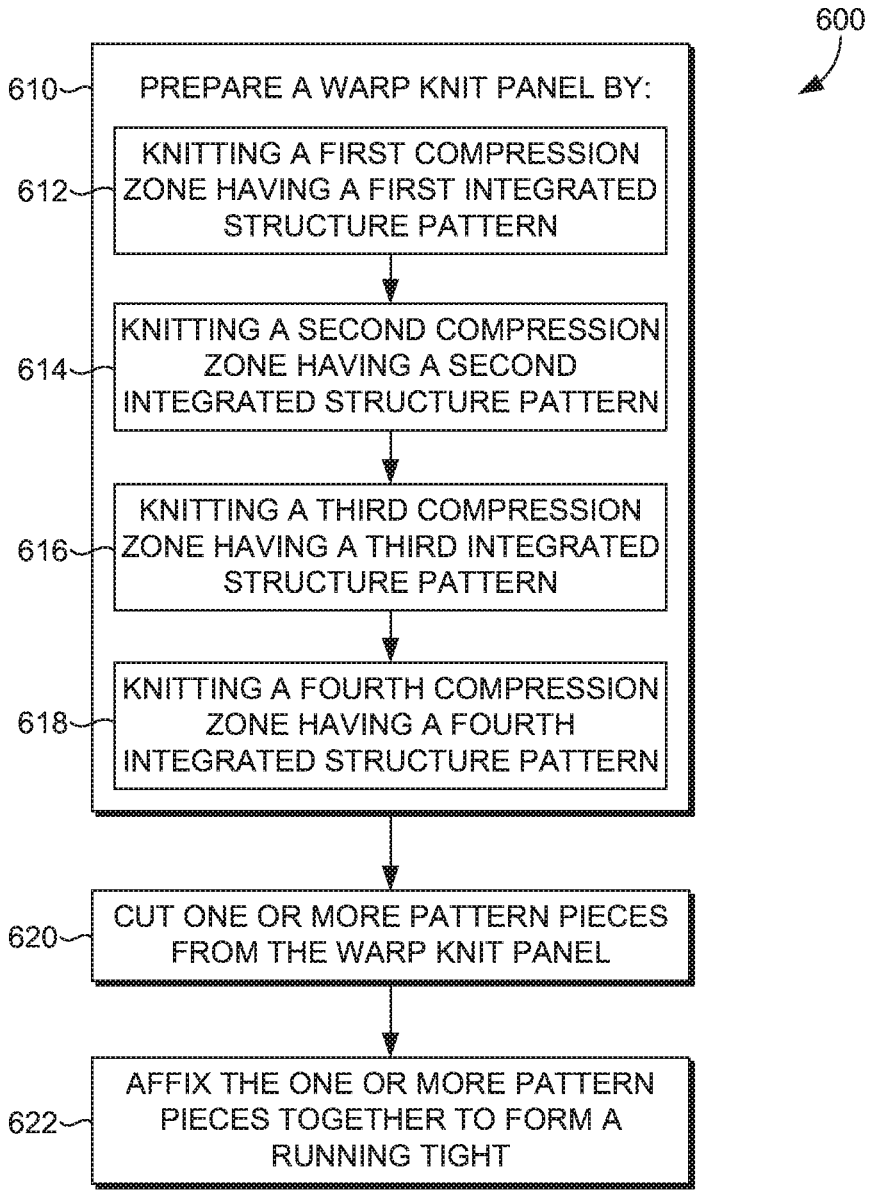
FIG. 6 illustrates a flow diagram of an exemplary method of manufacturing a warp knit running tight having preconfigured compression zones and integrated knit structure patterns in accordance with an aspect herein.

FIG. 6 illustrates a flow diagram of an exemplary method 600 of manufacturing a warp knit running tight such as the running tight 100 and/or the running tight 900. At a step 610, a panel is prepared. The panel may be prepared by utilizing a warp knitting process (single or double bar Jacquard) to knit a first compression zone, such as the first compression zone 116 and/or the compression zone 914, having a first modulus of elasticity and/or compression force at a step 612. The first compression zone may be formed using one or more elastic yarns having the same or different denier and having a predefined modulus of elasticity. The modulus of elasticity associated with the elastic yarn(s) may be due to the denier and/or diameter of the yarn, and/or due to the type of yarn used. Knitting the first compression zone may further comprise knitting a first integrated knit structure pattern as described herein.

At a step 614, a second compression zone, such as the second compression zone 118 and/or the compression zones 916 and 1010, is knitted where the second compression zone is adjacent to the first compression zone. The second compression zone has a second modulus of elasticity and/or compression force that is greater than the first modulus of elasticity and/or compression force associated with the first compression zone. The second compression zone may be formed using one or more elastic yarns having the same or different denier. The modulus of elasticity of the yarns used to knit the second compression zone is greater than the modulus of elasticity of the yarns used to knit the first compression zone. Knitting the second compression zone may comprise knitting a second integrated knit structure pattern as described herein.

At a step 616, a third compression zone, such as the third compression zone 120, may be knitted where the third compression zone is adjacent to the second compression zone. The third compression zone has a third modulus of elasticity and/or compression force that is less than the second modulus of elasticity and/or compression force associated with the second compression zone. In exemplary aspects, the third modulus of elasticity and/or compression force may be the same as the first modulus of elasticity and/or compression force associated with the first compression zone. The third compression zone may be formed using one or more elastic yarns having the same or different denier. The modulus of elasticity of the yarns used to knit the third compression zone may be less than the modulus of elasticity of the yarns used to knit the second compression zone. Knitting the third compression zone may comprise knitting a third integrated structure pattern as described herein.

At a step 618, a fourth compression zone, such as the fourth compression zone 122 and/or the compression zone 1012, is knitted where the fourth compression zone is adjacent to the third compression zone. The fourth compression zone has a fourth modulus of elasticity and/or compression force that is greater than the third modulus of elasticity and/or compression force associated with the third compression zone. In exemplary aspects, the fourth modulus of elasticity and/or compression force may be the same as the second modulus of elasticity and/or compression force associated with the second compression zone. The fourth compression zone may be formed using one or more elastic yarns having the same or different denier. The modulus of elasticity of the yarns used to form the fourth compression zone may be greater than the modulus of elasticity of the yarns used to knit the third compression zone. Knitting the fourth compression zone may comprise knitting a fourth integrated structure pattern as described herein. When using a single bar Jacquard warp knitting process, the first, second, third, and fourth compression zones may be simultaneously knitted by the warp knitting machine with the elastic yarns running the length of the compression zones.

Continuing with the method 600, as a step 620, one or more pattern pieces may be cut from the warp knit panel. And at a step 622, the one or more pattern pieces may be affixed together to form the running tight. The pattern pieces may differ when forming a tight for a man versus for a woman, when forming tights of different sizes, and/or when forming the tight as a capri, a half-tight, a three-quarter tight, and the like.

When knitting the panel using, for instance, a single bar Jaquard warp knitting process, the transition between the different compression zones may be configured in a gradient fashion or as more of an abrupt transition. For instance, an abrupt transition between the different compression zones may occur by setting up the warp such that yarns associated with, for instance, a first compression zone may be replaced with the yarns that will be used to form a second compression zone at the junction or demarcation between the two zones.

Figure 7:
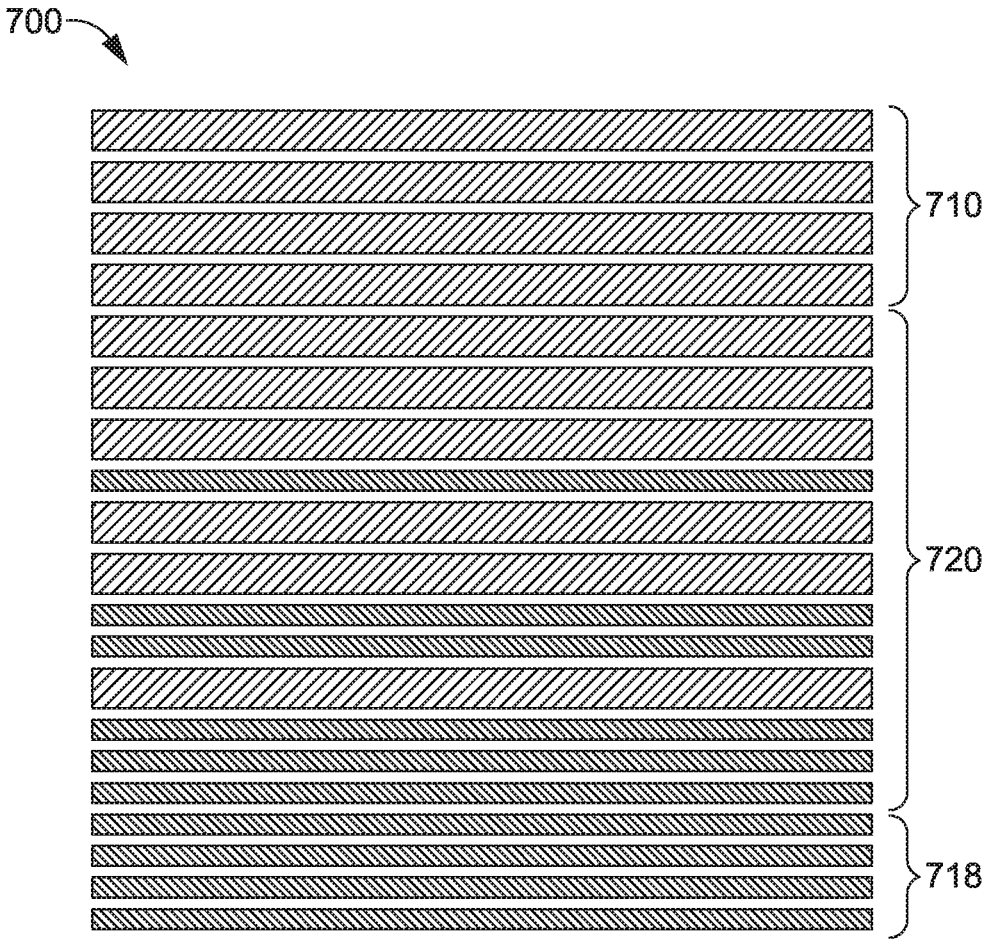
FIG. 7 illustrates a close-up view of an exemplary transition zone between a first compression zone and a second compression zone in accordance with an aspect herein.

In another exemplary aspect, the transition between the different compression zones may occur gradually by setting up the warp such that yarns used to knit a first compression zone are intermixed with yarns used to form a second compression zone at a transition area. An exemplary transition between different compression zones is shown in FIG. 7 and is referenced generally by the numeral 700. Reference numeral 710 indicates a first segment of warp yarns used to form a particular compression zone, such as, for example, the second compression zone 118. The yarns in the first segment 710 may have a large denier or diameter and a high modulus. Segment 718 indicates a second segment of warp yarns used to form, for example, the third compression zone 120. The yarns in the second segment 718 may have a smaller denier or diameter than the yarns in the first segment 710 and a smaller modulus of elasticity. The segment 720 represents the transition area between the second compression zone and the third compression zone. As shown, the yarns of the first segment 710 are intermixed with the yarns of the second segment 718 in the transition segment 720. The pattern of the yarns in the transition segment 720 may vary. For instance, the intermixing of the yarns having the differing deniers may occur in a gradient fashion with the yarns associated with the first segment 710 gradually being replaced with the yarns associated with the second segment 718 so that the concentration of yarns having the larger denier is greater adjacent to the second compression zone and the concentration of yarns having the smaller denier is greater adjacent to the third compression zone. This is just one exemplary pattern and other transition patterns are contemplated herein. Because the transition segment 720 comprises an intermixing of the yarns having the differing deniers and differing moduli of elasticity, the modulus of elasticity of the transition segment 720 may be between the modulus of elasticity of the first segment 710 and the second segment 718.

As described above, the panel may also be knit using a double bar Jacquard warp knitting process that allows the elastic yarns to be dropped in where needed. As such, there may not be a transition area such as that described with respect to FIG. 7 between the different compression areas or zones.

In exemplary aspects, the running tight may have color variation effect that is achieved by one of several methods. In one exemplary aspect, the color variation effect may comprise a dark colored tight with lighter-colored offset areas. This may be achieved by using, for instance, a cationic polyester yarn as the face yarn and, for example, a regular polyester yarn as the back yarn. In this aspect, the elastic yarns are uncolored. During the dyeing process, which may occur prior to the yarns being knitted to form the tight, the cationic polyester yarn may be dyed a dark color and the regular polyester yarn may be dyed a lighter color. By utilizing this stitch configuration and this dyeing process, the offset areas will be lighter in color than the remaining portions of the tight.

In another exemplary aspect, the color variation may comprise an iridescent effect in the solid-colored areas. This may be achieved by using a cationic polyester yarn as the face yarn and a regular polyester yarn as the back yarn. Again, the elastic yarns are uncolored. Similar to above, the cationic polyester yarn may be dyed a dark color and the regular polyester yarn may be dyed a lighter color. However, during the knitting of the tight, the stitch pattern is altered to allow a small amount of the lighter-colored back yarns to show through the dark-colored face yarns, thereby creating the iridescent effect. The offset areas, like above, are lighted colored.

In yet another exemplary aspect, the color variation may comprise a light colored tight with darker-colored offset areas. In this aspect, the regular polyester yarn comprises the face yarn and the cationic polyester yarn comprises the back yarn. During the dyeing process, the cationic polyester yarn may be dyed a dark color and the regular polyester yarn may be dyed a lighter color. By utilizing this dyeing process and this stitch configuration, the offset areas will be darker in color than the remaining portions of the tight.

Continuing, an additional type of iridescent effect may be achieved by using regular polyester yarn as the face yarn and a cationic polyester yarn as the back yarn. The cationic polyester yarn may be dyed a dark color and the regular polyester yarn may be dyed a lighter color. During the knitting of the tight, the stitch pattern is altered to allow a small amount of the darker-colored back yarn to show through light-colored face yarn, thereby creating the iridescent effect. The offset area are dark colored in this aspect.

In exemplary aspects, the elastic yarns may be covered with a polyester or cationic polyester yarn during spinning. The covered elastic yarn may then be dyed and incorporated into the tight in a manner similar to those described above to create the color variation effects noted above. Any and all such aspects, and any variation thereof, are contemplated as being within the scope herein.

Figure 8:
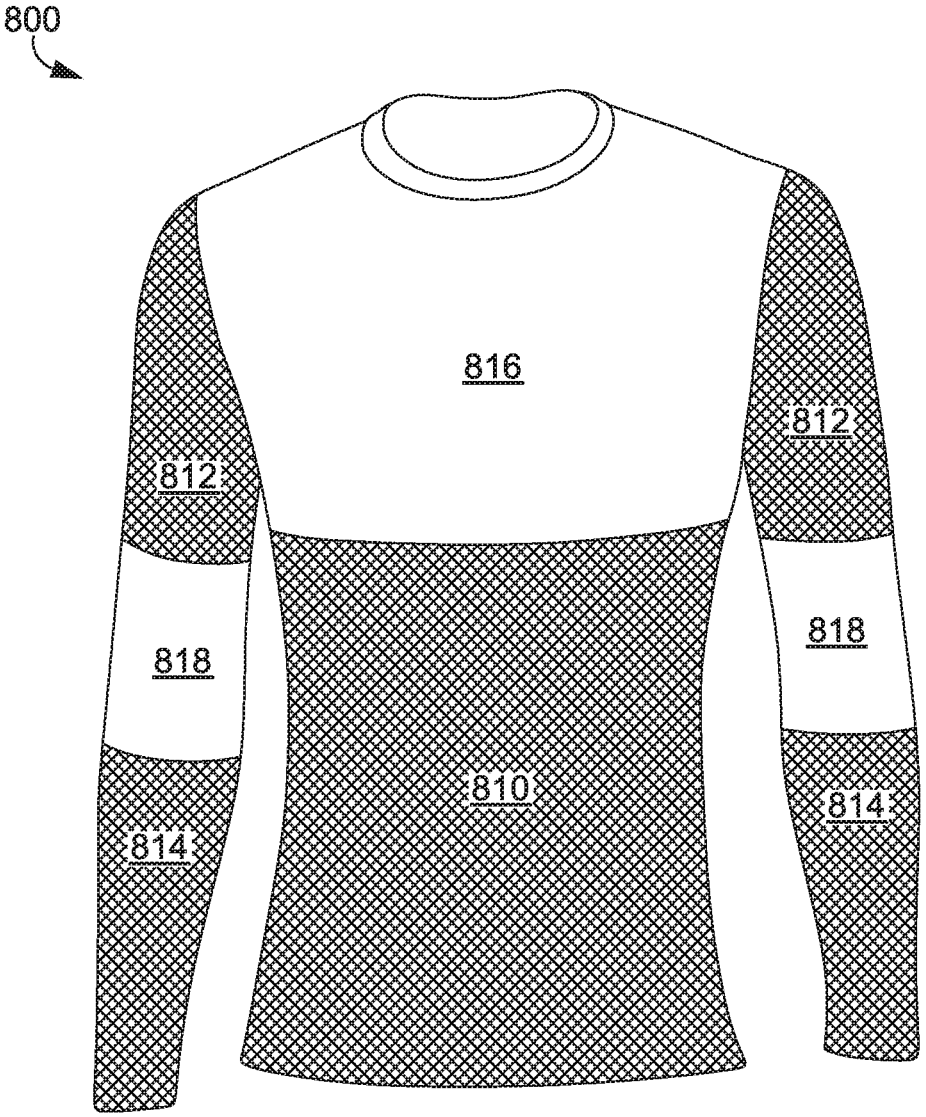
FIG. 8 illustrates an exemplary article of apparel for an upper torso of a wearer, the article of apparel having preconfigured compression zones and integrated knit structure patterns in accordance with an aspect herein.

FIG. 8 illustrates an exemplary article of apparel 800 for an upper torso of a wearer in accordance with an aspect herein. The article of apparel 800 is in the form of a long-sleeve shirt although other articles are contemplated herein such as a sleeveless tank top, a camisole, a bra, a short-sleeved shirt, and the like. The article of apparel 800 may be formed from a warp knitted fabric (single or double bar Jaquard), where the fabric is knitted to have different compression zones and/or different integrated knit structure patterns as described herein. In the exemplary aspect shown in FIG. 8, the article of apparel 800 is configured to have high compression zones over the wearer's torso area 810, upper arm area 812, and lower arm area 814, and low to medium compression zones over the wearer's upper chest area 816, and elbow area 818. This configuration may, for instance, help to stabilize the wearer's core, and minimize muscle vibration in the wearer's biceps and triceps while still providing mobility over the wearer's shoulder area and elbow area.

The configuration shown in FIG. 8 is exemplary only and it is contemplated herein that additional compression zone configurations may be used to achieve different functional purposes. For example, a high compression zone may be located over the wearer's lower back to help stabilize this area. Moreover, the integrated knit structure pattern in the form of repeating diamonds shown in FIG. 8 is exemplary only and it is contemplated herein that the apparel item 800 may have different structure patterns such as those shown in FIGS. **5A-5*s* or may not have any integrated structure patterns. Further, these structure patterns may be in different configurations than those shown in FIG. 8**. Any and all such aspects, and any variation thereof, are contemplated as being within the scope herein. The structure patterns may be used to further customize the amount of compression or the direction of compression associated with one or more of the compression zones as discussed herein.

From the foregoing, it will be seen that aspects herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects may be made without departing from the scope thereof, it is to be understood that all matter herein set forth or shown in the accompanying drawings is to be interpreted as illustrative and not in a limiting sense.

What is claimed is:

1. A running tight having a planar inner-facing surface, the running tight comprising:

a plurality of compression zones, each compression zone of the plurality of compression zones having an integrated structure pattern comprising a plurality of offset areas extending inwardly from an outer-facing surface of the running tight and delineating and defining a plurality of structures, the plurality of offset areas comprising a shorter length knit stitch having a shorter length as compared to a length of a knit stitch used to from the plurality of structures, wherein the plurality of offset areas within the integrated structure pattern has a higher modulus of elasticity value as compared to remaining areas within the respective compression zone without the integrated structure pattern, the plurality of compression zones comprising:

a first compression zone having a first modulus of elasticity value within a predefined range, the first compression zone located at an upper portion of the running tight, wherein the plurality of structures within the first compression zone include a series of vertically oriented parallel lines and a series of diamond shapes located adjacent to and below the series of vertically oriented parallel lines, the series of vertically oriented parallel lines and the series of diamond shapes located at lateral margins of the running tight;

a second compression zone having a second modulus of elasticity value within a predefined range, the second compression zone located adjacent to and inferior to the first compression zone, wherein the plurality of structures within the second compression zone include a series of diamond shapes that extend over an anterior portion of the running tight;

a third compression zone having a third modulus of elasticity value within a predefined range, the third compression zone located adjacent to and inferior to the second compression zone, wherein the plurality of structures within the third compression zone include a series of diamond shapes that extend over the anterior portion of the running tight; and a fourth compression zone having a fourth modulus of elasticity value within a predefined range, the fourth compression zone located adjacent to and inferior to the third compression zone, wherein the plurality of structures within the fourth compression zone include a series of diamond shapes and a series of vertically oriented parallel lines located adjacent to and below the series of diamond shapes, the series of diamond shapes and the series of vertically oriented parallel lines extending over a posterior portion of the running tight.

2. The running tight of claim 1, wherein the first modulus of elasticity value is equal to the third modulus of elasticity value.

3. The running tight of claim 2, wherein the second modulus of elasticity value is equal to the fourth modulus of elasticity value.

4. The running tight of claim 3, wherein the first and third modulus of elasticity values are less than the second and fourth modulus of elasticity values.

5. The running tight of claim 1, wherein:

the first compression zone is located over a lower torso area of a wearer when the running tight is in an as-worn configuration;

the second compression zone is located over a thigh area of the wearer when the running tight is in the as-worn configuration;

the third compression zone is located over a knee area of the wearer when the running tight is in the as-worn configuration; and the fourth compression zone is located over a calf area of the wearer when the running tight is in the as-worn configuration.

6. The running tight of claim 1, further comprising a first transition zone between the first compression zone and the second compression zone, wherein the first transition zone has a modulus of elasticity value that is between the first modulus of elasticity value and the second modulus of elasticity value.

7. The running tight of claim 6, further comprising a second transition zone between the second compression zone and the third compression zone, wherein the second transition zone has a modulus of elasticity value that is between the second modulus of elasticity value and the third modulus of elasticity value.

8. The running tight of claim 7, further comprising a third transition zone between the third compression zone and the fourth compression zone, wherein the third transition zone has a modulus of elasticity value that is between the third modulus of elasticity value and the fourth modulus of elasticity value.

9. The running tight of claim 1, wherein the series of diamond shapes in the second compression zone comprise an extension of the series of diamond shapes in the first compression zone.

10. The running tight of claim 1, wherein the series of diamond shapes in the third compression zone comprise an extension of the series of diamond shapes in the second compression zone.

* * * * *